US006154986A

United States Patent [19]

Hadler et al.

[11] Patent Number: 6,154,986

[45] Date of Patent: Dec. 5, 2000

[54] ARTICULATED SNOWPLOW SYSTEM

[75] Inventors: Howard Hadler, West Bend; John M. Struck, Iron Ridge; Lynn W. Schultz, Campbellsport; Terry Wendorff, Cedarburg, all of Wis.

[73] Assignee: Sno-Way International, Hartford, Wis.

[21] Appl. No.: 09/525,301

[22] Filed: Mar. 14, 2000

Related U.S. Application Data

[63] Continuation of application No. 09/185,198, Nov. 3, 1998, Pat. No. 6,044,579, which is a continuation of application No. 08/536,998, Sep. 29, 1995, Pat. No. 5,829,174, which is a continuation-in-part of application No. 08/225,215, Apr. 8, 1994, abandoned, which is a continuation-in-part of application No. 08/053,060, Apr. 26, 1993, abandoned.

[51] Int. Cl.[7] ..... E01H 5/04

[52] U.S. Cl. ..... 37/234; 172/801

[58] Field of Search ..... 37/324, 232, 233, 37/236, 235, 231, 348; 172/800, 801, 811

[56] References Cited

U.S. PATENT DOCUMENTS

| | | |
|---|---|---|
| 2,699,615 | 1/1955 | Malvese . |
| 3,175,313 | 3/1965 | Renahan . |
| 3,201,878 | 8/1965 | Markwardt . |
| 3,400,475 | 9/1968 | Peitl . |
| 3,432,946 | 3/1969 | Peitl . |
| 3,524,269 | 8/1970 | Jackoboice . |
| 3,749,180 | 7/1973 | Coontz . |
| 4,259,794 | 4/1981 | Rath . |
| 4,279,084 | 7/1981 | Low . |
| 4,439,939 | 4/1984 | Blau . |
| 4,807,375 | 2/1989 | Iraci . |
| 4,821,435 | 4/1989 | Pester . |
| 4,907,357 | 3/1990 | Lilienthal . |
| 4,962,598 | 10/1990 | Woodhiser . |
| 4,962,599 | 10/1990 | Harris . |
| 4,976,053 | 12/1990 | Caley . |
| 5,044,098 | 9/1991 | Berghefer . |
| 5,050,321 | 9/1991 | Evans . |
| 5,075,988 | 12/1991 | Ciula . |
| 5,081,775 | 1/1992 | Veilleux . |
| 5,082,065 | 1/1992 | Knowlton et al. . |
| 5,125,174 | 6/1992 | Watson et al. . |
| 5,193,296 | 3/1993 | Reilly . |
| 5,585,356 | 12/1996 | Winter . |
| 5,829,174 | 11/1998 | Hadler et al. . |

OTHER PUBLICATIONS

Hydra–Scoop Snow Plow, Farm Industry News, vol. 23, No. 7—No date.

*Primary Examiner*—Robert E. Pezzuto
*Attorney, Agent, or Firm*—Reinhart, Boerner, Van Deuren, Norris & Rieselbach, s.c.

[57] ABSTRACT

An articulated snow plow system for use with a vehicle includes a blade center section having a moldboard section and left and right plowblade sections which are wider than the blade center section. The plowblade sections each include a moldboard section and are mounted to the blade center section at opposite sides thereof and pivotable relative to the center blade section about a substantially vertical pivot axis, to swept forward and swept backward positions. The snowplow assembly includes a support frame, the blade center section being coupled to the support frame through an intermediate pivot assembly which permits a limited amount of float to allow the blade center section, and the plowblade sections pivoted thereto, to follow the contour of the ground. Pressure sensors associated with hydraulic cylinders which move the plowblade sections between extended and retracted position, respond to pressure within the hydraulic cylinder for the associated plowblade section exceeding a trip point to cause both of the plowblade sections to be retracted to a more straight position.

16 Claims, 26 Drawing Sheets

PRESSURE DOWN HYDRAULIC SYSTEM SCHEMATIC

DOWN & FLOAT WIRING SCHEMATIC

PRESSURE DOWN WIRING SCHEMATIC

RAISE WIRING SCHEMATIC

HOLD POSITION WIRING SCHEMATIC

FLOAT HYDRAULIC SYSTEM SCHEMATIC

PRESSURE DOWN HYDRAULIC SYSTEM SCHEMATIC

RAISE & HOLD HYDRAULIC SYSTEM SCHEMATIC

LOWERED POSITION

ARTICULATED SNOWPLOW SYSTEM

This application is a continuation of copending application(s) application No. 09/185,198 filed Nov. 3, 1998, now U.S. Pat. No. 6,044,579, which is a continuation-in-part of application Ser. No. 08/536,998, filed on Sep. 29, 1995, now U.S. Pat. No. 5,829,174, which is a continuation-in-part of application Ser. No. 08/225,215 filed Apr. 8, 1994, and which is now abandoned, which is a continuation-in-part of application Ser. No. 08/053,060, filed Apr. 26, 1993, and which is now abandoned.

BACKGROUND OF THE INVENTION

The present invention relates generally to the field of snow-plows and specifically to articulated snow plows. Generally the snow plow system disclosed herein is intended for use on vehicles like trucks, tractors, skid loaders, pick up trucks, sports utility vehicles, etcetera. However, the snow plow system disclosed herein, or at least some aspects of the snow plow system disclosed herein, is also viewed as having application on all types of snow removal vehicles.

Plows with blades that hinge have a number of advantages over plows with straight nonpivotable blades. A lightweight vehicle, carrying a plow cannot easily push deep, particularly hard, or heavy snow with a straight blade. A centrally hinged plow blade or moldboard (sometimes called an apex type plow because the hinge is at the apex of the V formed when the arms or wings of the plow are in a swept back position) allows the operator of the vehicle a greater mechanical advantage since a plow moldboard, with its wings in the swept back V shaped position, will act like a wedge into the snow. Each wing of the plow moldboard acting like an inclined plane depositing the snow to either side of the vehicle. A plow with a straight blade or moldboard also has difficulty in pushing a mound of snow to an out of the way location. Snow will spill out the sides of a plow with a straight moldboard while a hinged plow that can be articulated can have its wings or arms swept forward to form a V-shaped cup like area between the moveable arms of the moldboard. This swept forward position allows for better containment of the snow so that the snow may be moved out of the way without significant spillage.

Unfortunately, despite the many advantages that hinged plows have there are also disadvantages. For example, when the arms of the plow are in the swept forward position the volume of snow that can be moved is somewhat reduced. Additionally, the single center hinge of hinged snow plows can undergo tremendous stress during plowing, e.g., hitting curbs, rocks, or other objects, and thus the single hinge has a tendency to bend or even break after repeated encounters with such objects. Further, many such plows have very complicated designs which make them difficult or expensive to repair.

Additionally, hinged plows are generally not able to trip effectively when they are in the swept back or swept forward positions. This means that hinged plows have difficulty tipping or tilting in response to encountering a solid object like a curb, an elevated portion of the road bed, a manhole cover, etc. This can lead to jarring impacts which are not desirable and which may adversely affect both the structural integrity of the vehicle and the plow. To attempt to compensate for this problem hinged plows are usually provided with extra mass to prevent damage.

However, additional weight or mass can adversely affect the fuel economy, the handling, and/or the structural integrity of the vehicle to which the plow is mounted and does not make the hinged plow trip in a more effective manner.

It is an object of the present invention to produce an articulated plow system having a center section with at least two or a plurality of pivot points (hinge points) instead one pivot point. The system disclosed herein will thus have a moldboard which can articulate. This means that the moldboard will have a plurality of joints or hinge areas about which portions of the moldboard can pivot.

It is a further object of the present invention to provide a pivot between the main frame and the central section of the blade assembly pivot to allow a few degrees of motion about a horizontal axis. The object is to provide a limited amount of float to permit the blade assembly to follow ground contours and allow for some variations in the mounting height of the vehicle mounting points.

It is a general goal of the present invention to produce an articulated plow system, a plow system having at least two or a plurality of joints, having features which overcome the above noted problems and at the same time provide a snow plow having the advantages of a hinged plow and a regular straight plow.

Further, hinged plows, as previously noted, typically have a point, the apex, where the hinge is located. The apex does not have a wearstrip in front of it to contact snow when plowing. Consequently, when a hinged plow is in the position or the swept back position this results in some snow being missed and a trail of unplowed snow being left behind the vehicle. This is not desirable because it requires that the driver make another sweep of the area just plowed to remove the trail of snow left. This wastes both the time and energy of the driver and the vehicle.

Thus, it is a further object of the present invention to provide a center section which can allow for the installation of a center wearstrip in a such a way that the center and wing wearstrips can overlap. Additionally, it is an object of this invention that the center strip be wide enough to accommodate such overlapping but also be narrow enough to allow for free flow of material across the wearstrip and moldboard surface when the blade assembly is angled fully to the right or to the left.

Further, it is an object of the present invention to use a center wearstrip that sufficiently angled with respect to the road or surface to be plowed so that a wedge or chisel affect to provide additional mechanical advantage to break up hard packed snow.

It is a further object of the present invention to include trip springs and pivots mounted to the center section independent of the main frame to allow for float between the main frame and the blade assembly section. Additionally, it is an object of the present invention to provide a center section having a width substantially greater than the single hinge width of apex type plows to provide more stability to the articulated plow system disclosed herein, greater resistance to side loading, and more durability. Further, by increasing the size of the center section more space is provided on the plow body itself for the tripping structure without any compromise to the structural integrity of the plow or its ability to pivot as desired.

It is a further objective of the present invention to permit blade tripping when the articulated plow disclosed herein is in the scoop position; with the wings of the plow swept forward.

It is a further object of the present invention to produce a plow system that may also be used on vehicles that are not well suited to heavy plows or to be used on vehicles where fuel economy is a consideration. Accordingly, the articulated plow blade of the present invention is designed so that it may be lighter in weight than prior art apex type plows.

It is a further object of the present invention to have a self-contained power unit and means of attaching the power unit mounted on the articulated plow and not the vehicle. This has the advantage of requiring less modification to the vehicle upon which the plow will be used. This will also aid in maintaining the center of gravity of the vehicle to help make the vehicle more stable since the majority of the weight added to the vehicle will be as part of the articulated plow located in front of the vehicle generally below the passenger compartment or cab. This allows the weight of the power unit to become an effective weight at the wearstrip rather than being fixed weight at the vehicle which is not desirable.

It is a further object of the present invention to address the problem of excess, performance reducing, weight on hinged snow plows. The present invention includes a reactive controlled pressure system that places a controlled predetermined pressure upon the moldboard of the plow system so that a portion of the weight of the vehicle to which the plow system is attached is actually transferred to the bottom edge of the plow moldboard and the plow moldboard acts as a moldboard weighing 2 to 3 times its actual weight. This allows the articulated plow blade of the present invention to be lighter in weight but to be as effective or even more effective in plowing as a hinged plow system.

It is a further objective of the present invention to provide the flexibility of having, in effect, both a light weight articulated plow (which is advantageous for certain conditions such as plowing light snow on a gravel driveway) and a heavy weight plow (which is advantageous for plowing drifted and hard packed snow and for scraping hard surfaces). This flexibility is obtained by having a reactive controlled pressure system which can be activated and de-activated by means of a simple electric control switch. The controlled pressure mechanism maintains a pressure within a certain predetermined low pressure and high pressure limit with a predetermined nominal pressure within these limits.

It is a further objective of the present invention to provide an articulated plow having a bell crank lift arm combination for lifting the articulated plow.

It is a further object of the present invention to have only a small mounting subframe located beneath the front bumper of the vehicle which is attached to the vehicle frame. All other components of the snow plow system are mounted to this mounting subframe so that they can be easily and quickly removed from the vehicle. Consequently, there is no substantial amount of mounting equipment covering the front end of the vehicle and little added weight permanently attached to the vehicle.

It is a further objective of the present invention to include a quick connecting/disconnecting structure to make it very easy to attach or disengage the snow-plow system from the vehicle. This saves the operator of the vehicle both time and effort when installing and removing the snow plow system.

Further, the present invention addresses the problem of lights mounted to vehicles for plowing. Typically an additional set of headlights and parking lights are mounted to the front end of a vehicle for plowing. This is because the regular headlights and parking lights of the vehicle are usually hidden behind the plow moldboard and thus are obstructed by the plow moldboard especially in the raised position. As such, the lights are rendered ineffective. Consequently it has been the case that an additional set of lights are mounted either upon the hood or up on the front grill of the vehicle so that they project over the front edge of the plow moldboard. The problem with this procedure is that these lights and their housings in and of themselves create obstructions in the driver's field of vision due to the fact that they are mounted on the vehicle. To overcome this problem it has been attempted in the prior art, in straight or traditional plows, to move the lighting system to a position off the vehicle and onto the plow structure itself. The device of the present invention moves these lights off of the vehicle and positions them so that they shine over the top edge of the moldboard, while presenting a minimal obstruction to the field of vision of the driver or operator of the vehicle. Since the additional lights are mounted on the plow and not on the vehicle they are removed when the snow-plow is removed. This eliminates having a second set of lights permanently mounted on the vehicle. Further, it is an objective of the present invention to allow these lights to be mounted to a fixed position or mounted to a telescoping mount so that their position may be independently adjusted.

It is a further object of the present invention to provide a simplified structure for moldboard attachment to an articulated plow system wherein the moldboard is retained to the moldboard structure by a special retaining means that allows for easy replacement of the moldboard.

Finally, it is an object of the present invention to provide a U shaped articulated plow form so that a greater volume of snow can be collected between the wings or arms of the plow. This also makes it possible to contain and control the snow mass better and lends itself to ease of cleaning up the surface area from which the snow is being removed.

The inventors do not know of any prior art that either teaches or discloses the unique features of the present invention.

SUMMARY OF THE INVENTION

The present invention is an articulating snow plow system having several major features: a lighting system, a quick and easy connect/disconnect system, a reactive controlled pressure mechanism for applying a controlled pressure to the bottom edge of the moldboard of the plow, a simple electric control to activate or deactivate the reactive controlled pressure mechanism, a bell crank system for adjusting the attitude of the moldboard, a special retaining system for retaining the moldboard, a reactive pressure mechanism for articulating the wing segments of the snow plow in response to obstacles encountered by the plow, and a floating mechanism designed to provide the plow blades with a few degrees of float independent of the main support structure or frame.

Accordingly, the present invention may be summarized as an articulated snow plow system for use with a motorized vehicle. The articulated snow plow system comprising an articulated snow plow coupled to a reactive controlled pressure snow plow system for use with the articulated snow plow. The articulated snow plow having a moldboard and the reactive controlled pressure snow plow system including a reactive controlled pressure mechanism mechanically coupled to the vehicle and to the moldboard of the articulated snow plow. A reactive controlled pressure system for controlling the reactive controlled pressure mechanism by supplying and removing a non-compressible fluid from the reactive controlled control mechanism in response to changes exceeding a predetermined pressure range within the reactive controlled pressure mechanism. The reactive controlled pressure system being connected to the reactive controlled pressure mechanism.

The present invention may alternatively be described as an articulated snow plow system for use with a motorized vehicle comprising an articulated snow plow coupled to a quick mount system for mounting an articulated snow plow to a vehicle, the quick mounting system including a support mechanism coupled to the articulated snow plow and having at least three mounting points. A frame structure having at least three mounting points. A connecting mechanism connecting the mounting points of the frame structure to the mounting points of the support mechanism. The mounting points of the frame structure being connected to the mounting points of the support mechanism by the connecting mechanism. The support mechanism being connected to the vehicle and the frame structure being connected to the articulated snow plow.

The mounting system further including a lighting system comprising at least one light connected to a support frame. A subframe connected to the vehicle. A connecting means for rigidly connecting the support frame to the subframe. The support frame being connected to the subframe by the connecting means.

The reactive controlled pressure system further including a lighting system comprising at least one light connected to a support frame. A subframe connected to the vehicle. A connecting means for rigidly connecting the support frame to the subframe. The support frame being connected to the subframe by the connecting means.

The reactive controlled pressure system further including a quick mount system for mounting the articulated snow plow system to a vehicle, the quick mounting system comprising a support means for supporting the snow-plow, the support means having at least three mounting points. A frame having at least three mounting points. A connecting means for connecting the mounting points of the frame to the mounting points of the support means. The mounting points of the frame being connected to the mounting points of the support means by the connecting means. The support means being connected to the vehicle and the frame being connected to the snow-plow.

The reactive controlled pressure system further including a lighting system for connecting to the articulated snow plow system for use with a motorized vehicle, the lighting system comprising at least one light connected to a support frame. A subframe connected to the vehicle. A connecting means for rigidly connecting the support frame to the subframe. The support frame being connected to the sjib-frame by the connecting means. The reactive controlled pressure snow-plow system can be activated or de-activated by an electric control switch.

Alternatively, the present invention may be described as a lighting system for use with an articulated snow plow system for use with a motorized vehicle, the lighting system comprising at least one light connected to a telescopically adjustable support frame. A subframe connected to the vehicle. A connecting means for rigidly connecting the support frame to the subframe. The support frame being connected to the subframe by the connecting means.

Also the present invention may be described as an articulated snowplow system for use with a vehicle comprising a mounting plow blade section having a moldboard section, at least two mounting sides, and at least one mounting structure located on each of the mounting sides. A plurality of extending plowblade sections each having a moldboard section and an engagement mechanism capable of engaging the mounting structure located on each of the mounting sides. An extending plowblade section being pivotally coupled to each mounting structure at the engagement mechanism.

The articulated snow plow system further including the combination of the engagement mechanism and the mounting structure, pivotally connected to each other, comprise: a hinge mechanism.

The articulated snow plow system further including the engagement mechanism and the mounting structure each comprise a series of sockets having openings. The sockets being aligned so that the spatial orientation of the openings of each socket is aligned along a substantially vertical axis; and a pin structure extending through each opening.

The articulated snow plow system further including an A-frame structure; (Any person reading or interpreting this patent should note that sometimes in this specification the plow support frame is referred to as the A-frame structure but it is not intended that-the scope of the invention disclosed and claimed herein be limited to that structure and that other frame structures could be substituted. Thus any frame structure which functions in a manner equivalent to the present structure should be considered to be literally within the definition of A-frame as used herein) at least one trip spring, and at least one pivot. The trip spring and the pivot being mounted to the mounting plowblade section independent of the A-frame.

The articulated snow plow system further including a support bracket . mechanism on the vehicle for receivably accepting a plow support frame. A plow support frame adapted for being coupled to the vehicle bracket mechanism and including an adjusting mechanism for adjusting the angular orientation of the mounting plowblade section and the extending plowblade sections. The mounting plowblade section coupled to the plow support frame and to the adjusting mechanism. A bell crank mechanism coupled between the front of the vehicle and a forward portion of the frame to permit vertical adjustment of the mounting plowblade section and the extending plowblade sections. A cylinder mechanism mounted to the frame and having a piston rod structure coupled to the bell crank mechanism for moving same to cause vertical adjustment, and fluid for extending and retracting the piston rod mechanism. A first bell crank coupling structure for coupling the bell crank mechanism to the vehicle bracket structure above the snow plow support frame structure (A-frame) and a second bell crank coupling structure on the frame generally adjacent the plow blade. The bell crank mechanism including a first link member which is coupled, at its first end, to the vehicle bracket structure by the first bell crank coupling structure and a second generally L-shaped link member having first and second ends. The second end of the first link member and the first end of the second link member being pivotally coupled to each other. The second end of the second link member being pivotally coupled to the piston rod of the first cylinder. The angular corner of the second link member being pivotally coupled to the second bell crank coupling bracket mechanism.

Alternatively, the above noted structure of the present invention could also be defined as a direct linkage system in which a short stroke actuator (e.g., a hydraulic cylinder) is used to provide a greater lift height to the snow plow as a result of the leverage of the linkage mechanism. For example, the actuator stroke could be limited four inches but the leverage could be adjusted so that the four inch stroke results in snow plow being lifted 20 inches. The amount of leverage affecting how much the snow plow may be raised could be varied depending upon the amount of additional linkage structure used or the length of the lever arm.

Consequently, an support frame structure used in the structure of the present invention which functions in a manner equivalent to the present structure should be considered to be literally with in the definition of support frame bracket mechanism of the present invention.

The articulated snow plow system having a substantially U shape when the extending plowblade sections are swept forward.

The articulated snow plow system further including a plurality of wearstrips. At least one wearstrip being mounted to the moldboard section of the mounting plowblade section and each extending plowblade section. The wearstrips being spatially orientated to overlap. The wearstrip of the mounting plowblade section has two ends and each end of the wearstrip overlaps a portion of the wearstrip of each extending plowblade section. The wearstrip of the mounting plowblade section having thickness of approximately of one (1) inch. Of course, this dimension is not critical. It is only important to note that the dimension should, preferably, be sufficient to prevent interference with the flow of snow across the moldboards of the plow when they are articulated to be angled either fully to the right or to the left.

The articulated snow plow system further including a plurality of hydraulic extension and retraction mechanisms each having a first end and a second end. The first end of each hydraulic extension and retraction mechanism being coupled to the mounting plowblade section. The second end of each hydraulic extension and retraction mechanism being coupled to a respective extending plow blade section. The hydraulic extension and retraction me cham sms being dual or double acting hydraulic cylinders.

The articulated snow plow system wherein the hydraulic extension and retraction mechanisms are coupled, via a plurality of hydraulic line structures, to a hydraulic control system. The hydraulic control system comprising a plurality of pressure switches, relief valves, and a reservoir. A hydraulic fluid being contained in both the hydraulic extension and retraction mechanisms, the hydraulic line structures, and the hydraulic control system. The hydraulic fluid capable of flowing into and out of the hydraulic extension and retraction mechanisms via the hydraulic line structures. At least one pressure switch mechanism being coupled to a valve mechanism. The valve mechanism being coupled to the hydraulic line structures and located between each the hydraulic extension and retraction mechanism and the reservoir. Each pressure switch mechanism capable of being actuated at predetermined pressure to actuate the valve mechanism coupled to a hydraulic line structure coupled to the reservoir. The hydraulic fluid capable of moving into the reservoir when the valve mechanism is open. The pressure switch mechanism (typically a pressure switch) is actuated by a predetermined increase in pressure greater than the forces encountered in normal plowing. In the specific structure disclosed herein this is a force exceeding approximately 1600 pounds per square inch of hydraulic fluid pressure.

The system of the present invention further includes pressure relief valves to permit hydraulic fluid to be directed to the reservoir in the unlikely event that a pressure switch fails and does not activate the valve mechanism to allow fluid to move into the reservoir. The pressure relief valve will activate if the system pressure reaches a level significantly higher than the pressure switch setting. For example, in the present system a 2000 psi pressure relief valve is used in conjunction with a 1600 psi pressure switch setting. When the hydraulic pressure exceeds the relief valve pressure limit the valve will open and dump the hydraulic fluid into the reservoir.

The articulated snow plow system further including a moldboard section of the mounting plowblade section having an upper edge and a lower edge. The moldboard sections of the plurality of extending plowblade sections having an upper edge and a lower edge. The moldboard sections having an upper portion and a lower portion and being fastened to the blade structure by a retaining mechanism, the retaining mechanism comprising a fastener and at least one lower retaining channel structure located on each the mounting plowblade section and on each the extending plowblade section, respectively. The fastener fastening the upper edge of the moldboard to the upper portion of the blade structure. The lower retaining channel structure comprises a channel presented between a wearstrip, coupled to the lower portion of the blade frame, and the blade frame. Additionally, a second or even a third moldboard could be placed between the moldboard and the blade frame. It should be noted that in the presently proposed commercial embodiment of the present invention the center section of the articulated plow is not designed to have a retained moldboard but that other embodiments could contain this feature without departing from the invention as disclosed and claimed herein.

The articulated snow plow system additionally including having a moldboard section of the mounting plowblade section having an upper edge and a lower edge. The moldboard sections of the plurality of extending plowblade sections have an upper edge and a lower edge. The moldboard sections being fastened to the blade structure by a retaining mechanism, the retaining mechanism comprising at least one upper retaining channel structure and at least one lower retaining channel structure located on each the mounting plowblade section and on each the extending plowblade section.

The mounting plowblade section and the extending plow blade sections each having an upper edge and a lower edge and a blade frame, respectively. The upper retaining channel comprising a channel presented between a retaining strip fastened to each respective upper edge and the blade frame.

Alternatively, the mounting plowblade section and the extending plow blade sections each having an upper edge and a lower edge and a blade frame, respectively. The lower retaining channel structure including a channel presented between a wearstrip mounted to the lower edge and the blade frame.

Alternatively, at least one of the moldboard section is comprised of a substantially clear material like LEXAN brand clear plastic material.

DESCRIPTION OF THE DRAWINGS

FIG. 1 is a top plan view of a nonarticulable snow plow system.

FIG. 2 is a side plan view of the nonarticulable snow-plow system.

FIG. 3 is a schematic view showing the valve block and the main hydraulic or reactive constant pressure cylinder.

FIG. 4 is a rear plan view of the lighting system.

FIG. 5 is a schematic view of the electrical control circuit showing the circuit engaged in the blade down and float configuration.

FIG. 6 is a schematic view of the electrical control circuit showing the circuit engaged in the pressure down configuration.

FIG. 7 is a schematic view of the electrical control circuit showing the circuit engaged in the raise configuration.

FIG. 8 is a schematic view of the electrical control circuit showing the circuit engaged in the hold configuration.

FIG. 9 is a schematic view showing the hydraulic control system in the blade float configuration.

FIG. 10 is a schematic view showing the hydraulic control system in the pressure down configuration.

DETAILED DESCRIPTION

Figure 1:
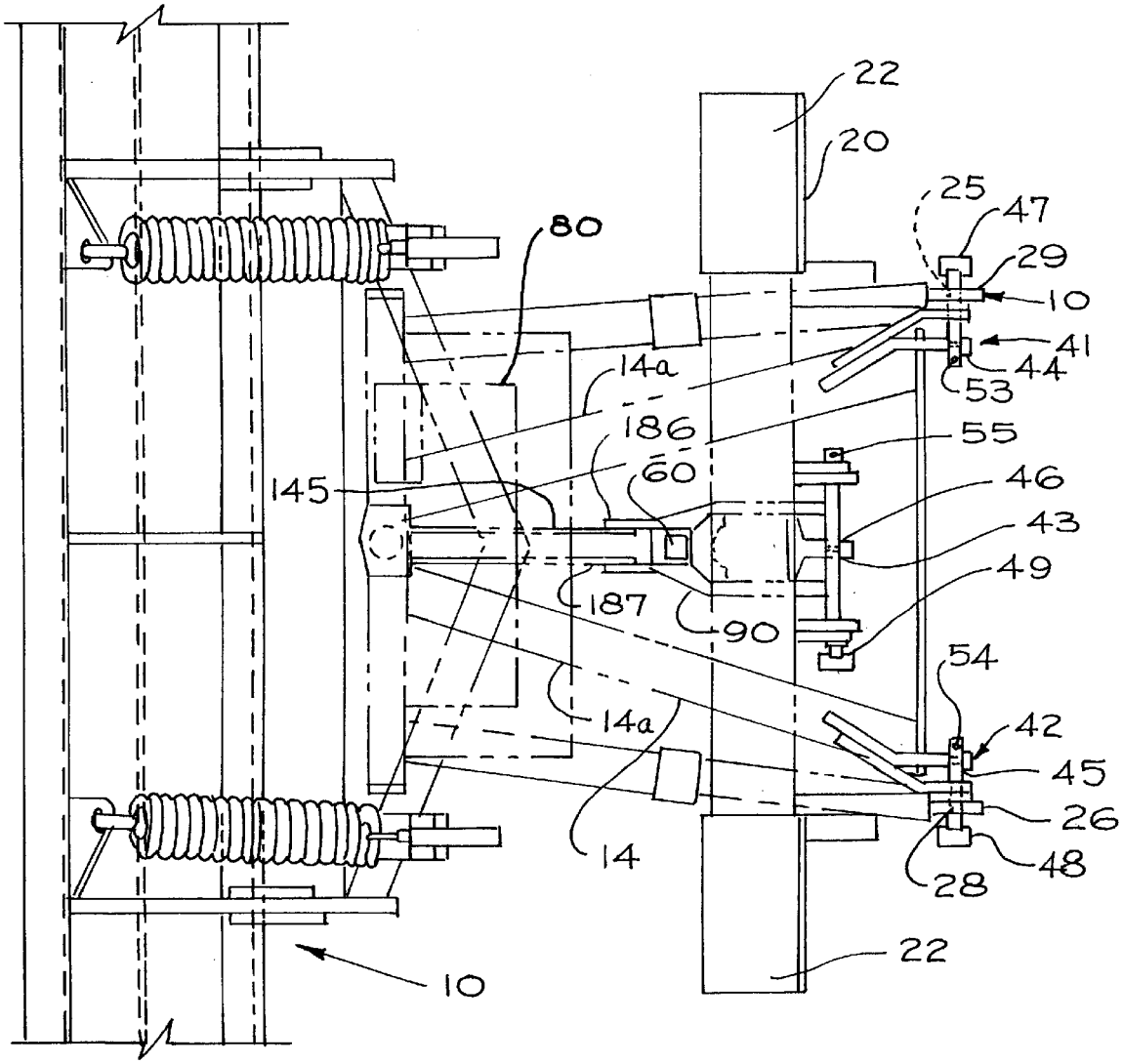
FIGS. 1–10 show various views of some of the features of the present invention in conjunction with a standard non-articulable plow blade system to provide background and to illustrate by comparison the advantages of the present invention.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Referring to FIGS. 1–12, some of the features of the present invention may be seen in combination with a non-articulated plow system as previously disclosed in U.S. patent application Ser. No. 08/225,215, filed on Apr. 8, 1994 now abandoned.

The main features of the nonarticulated snow plow system 10 are a lighting system 20, a mounting system 40, a reactive controlled pressure system 60, and an electronic control for engaging and disengaging the controlled pressure system 70. The. nonarticulated snow plow system 10 further includes a moldboard 100 and an A-frame 14 for supporting and connecting the components of the nonarticulated snow plow system 10.

Figure 2:
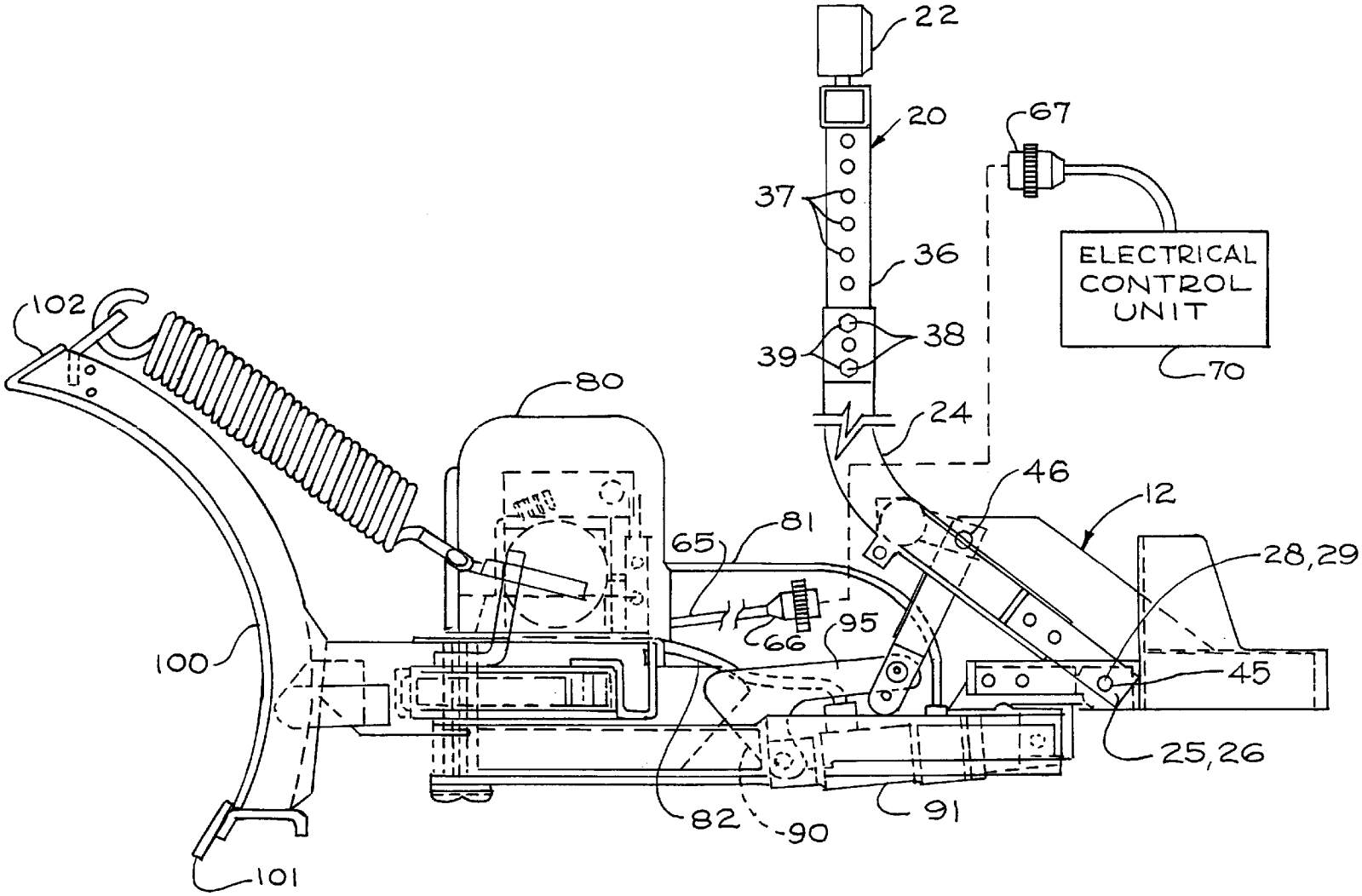
Figure 3:
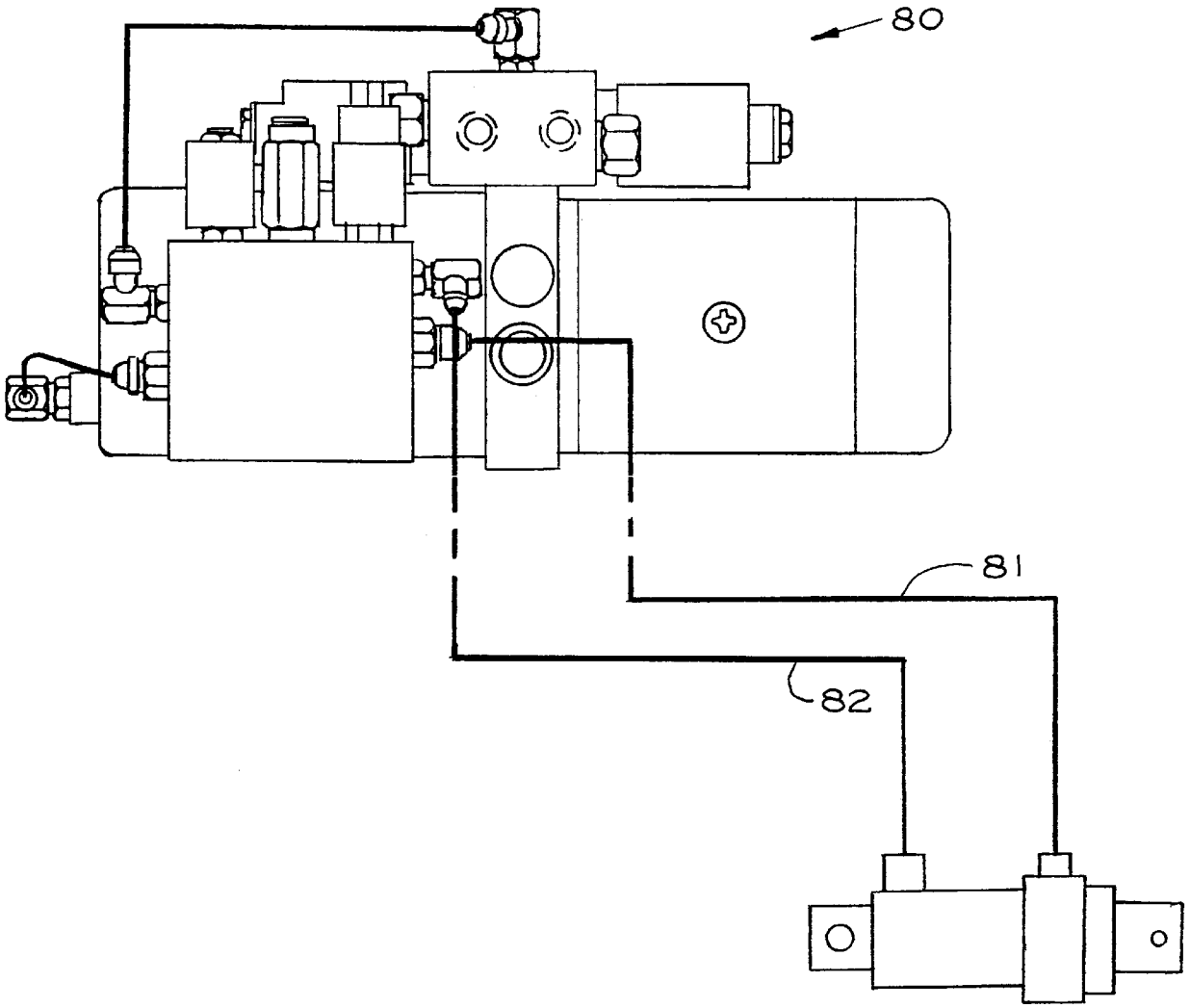
Figure 12:
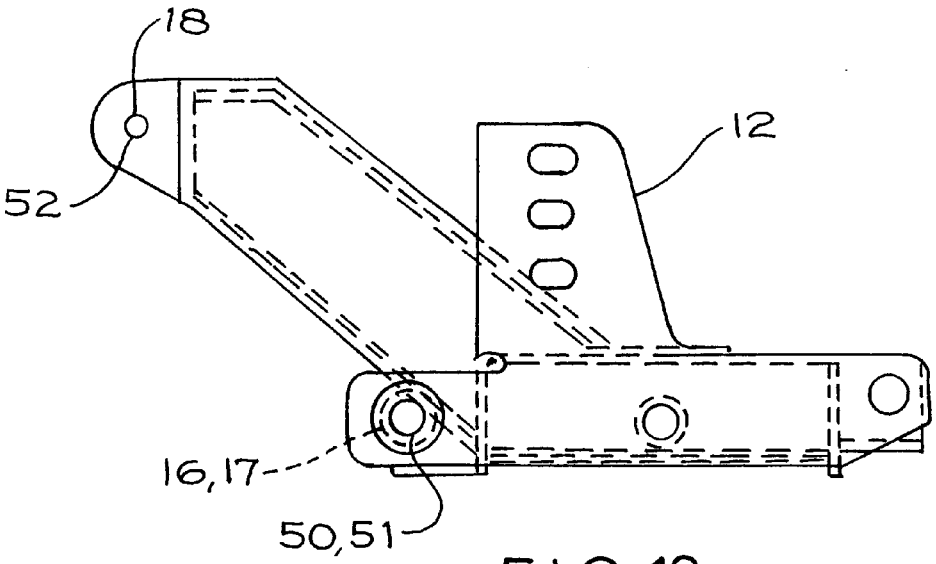
FIG. 12 is side plan view of the vehicle bracket or subframe.
Figure 5:
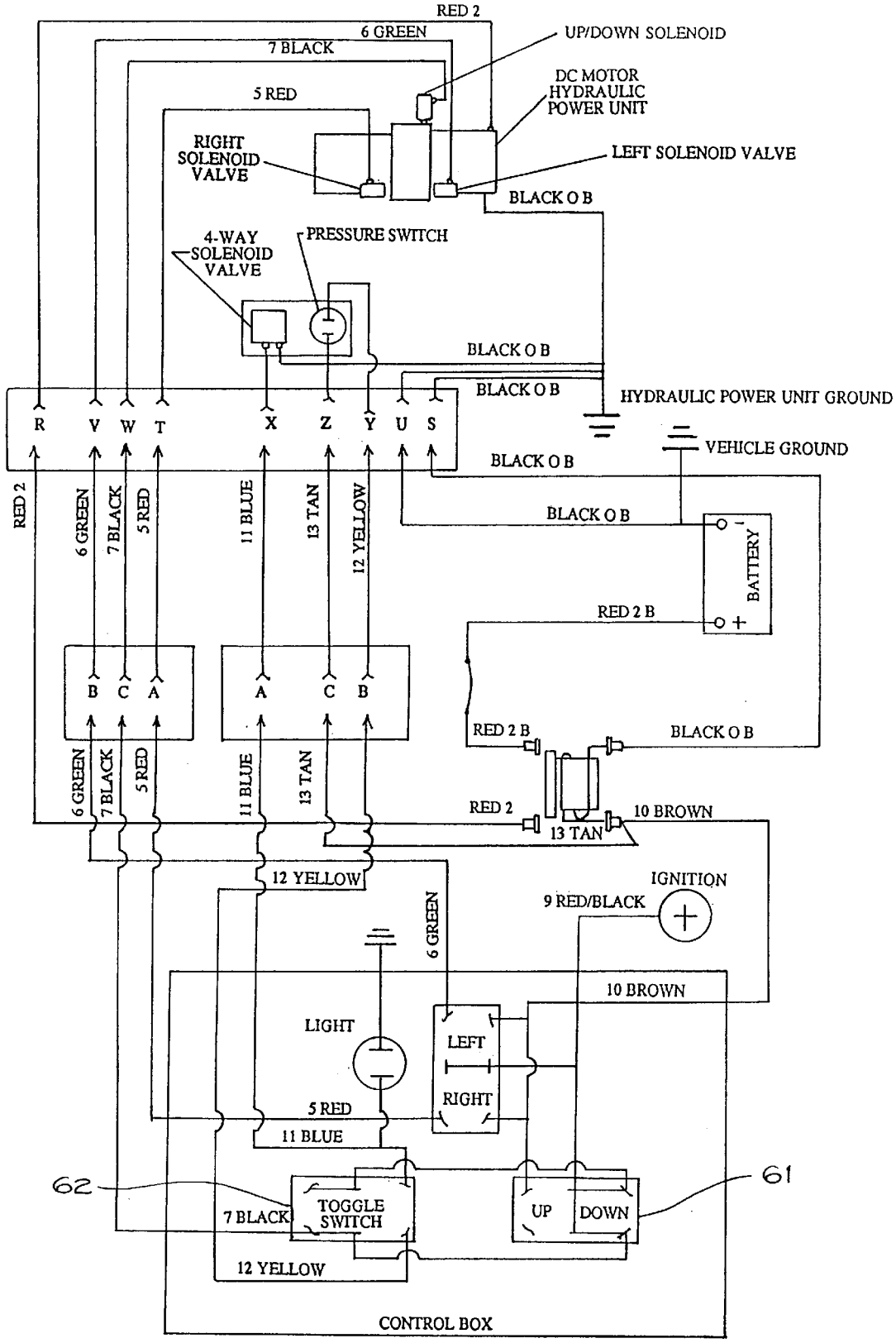

The nonarticulated snow plow system 10 is connected to the frame of the vehicle 11 with mounting system 40. Referring to FIGS. 2 and 12 the nonarticulated snow plow system 10 may be seen to be connected to the vehicle 11 by a mounting subframe 12 that is fixedly connected to the frame of the vehicle 11. The mounting system 40 is integral to the A-frame 14 as shown in FIG. 1. The subframe 12 has mounting points 16–18 having openings 50–52 as shown in FIG. 12. The mounting system 40 has three mounting points 41–43, having openings 44–46, and three mounting pins 47–49. Mounting points 16–18 of the subframe 12 correspond to mounting points 41–43 of the mounting system 40 so that openings 50–52 align respectively with openings 44–46. Pins 47–49 pass through the aligned openings 50–52 and 44–46. Locking pins 53–55 are respectively used to hold the pins 41–43 in place in the openings 50–52 and 44–46 during operation of the vehicle 11. In this manner the nonarticulated snow plow system 10 of the present invention is quickly and easily mounted to the vehicle 11 so that there is a rigid and fixed connection between the vehicle 11 and the nonarticulated snow plow system 10 through the mounting subframe 12 which is attached to the frame of the vehicle 11.

Figure 4:
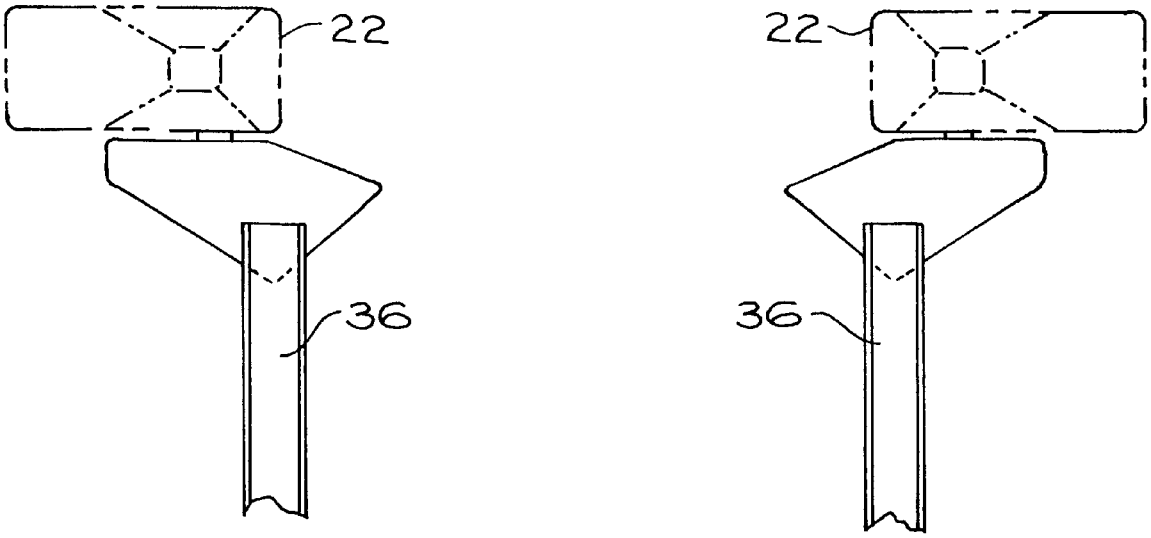

Referring now to FIGS. 1, 2, and 4 the lighting system 20 may be seen to comprise a set of high intensity light road lights 22 mounted to a support frame 24. Any type of lights 22 providing sufficient illumination could be used. The lights 22 are powered from the vehicle 11 in a known manner. The support frame 24 has two mounting points 25–26 having openings 28–29. As specifically shown in FIGS. 1 and 2 the mounting points 25–26 line up with the mounting points 41 and 42 of the mounting system 40. Accordingly, the support frame 24 is fixedly and rigidly mounted to the subframe 12 by the same mounting system 40 as is the rest of the nonarticulated snow plow system 10 by the pins 47 and 48 of the mounting system 40. In this manner the lighting system 20 is rigidly and fixedly mounted to the vehicle 11 with the lights 22 positioned to shine over the top edge 102 of the moldboard 100 and at the same time being set off from the body of the vehicle 11 to minimize any obstructions to the vehicle operator's field of vision.

Further, referring specifically to FIG. 2, the support frame 24 may be seen to include two posts 36 that are telescopically adjustable to move the lights 22 vertically up or down with respect to the plow system 10. A plurality of openings 37 extend up and down the sides of the posts 36. Once the proper height for the lights 22 has been determined the openings 37 in the telescoping posts 36 are aligned with openings 39 in support frame 24 and bolts 38 are passed through the openings 37 and 39. Each bolt 38 is secured by using a nut. This holds the lights 22 in the vertical position desired. Accordingly, the lighting system 20 of the present invention may be easily adjusted to the needs of the individual vehicle operator and in order to obtain maximum illumination of the area in front of the vehicle regardless of the snow plow's position.

Referring to FIGS. 1–3 and 5–12 the reactive controlled pressure system 60 may be seen to comprise an electrical control unit 70, a hydraulic control/power unit 80, and a hydraulic cylinder linkage 90. As can be seen in FIG. 2, hydraulic cylinder linkage 90 includes a bell crank 95 to aid in the effective transference of weight or force from the mass of the vehicle 11 to the bottom edge 101 of the moldboard 100. While a bell crank 95 is the means of mechanical linkage disclosed, it is not the only possible means for accomplishing the same function.

The electrical control unit 70 is shown schematically in FIGS. 5–8. The electrical control unit 70 operates off the battery power of the vehicle 11 and is energized when the vehicle ignition key is turned to the accessory setting or when the engine of the vehicle 11 is running. The electrical control wiring harness 65 includes a plug 66 and a receptacle 67 that can be separated when the snowplow system 10 is removed from vehicle 11. As shown in FIGS. 5–7B, the electrical control unit 70 has two switches 61 and 62 that control the hydraulic lift and reactive pressure control unit 80.

Figure 18:
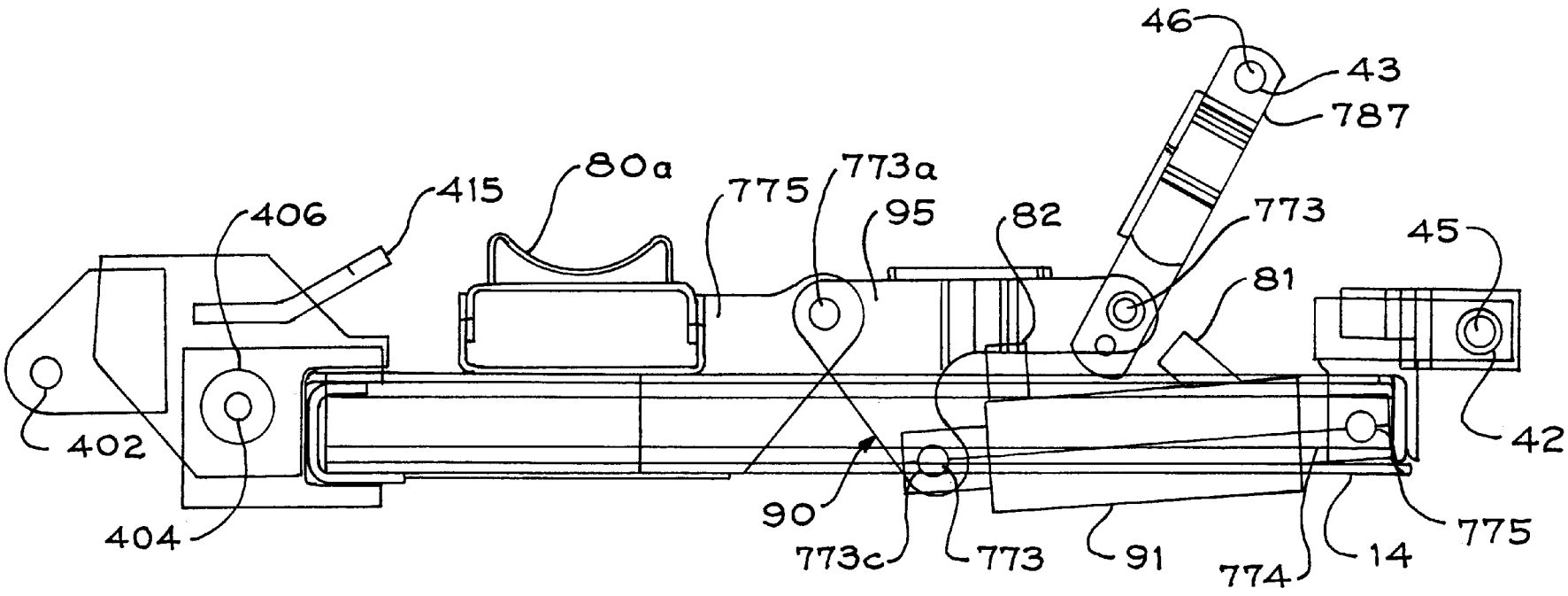
FIG. 18 is a side elevational view of the bell crank lifting system used in combination with the articulated plow system in the lowered position.
Figure 18A:
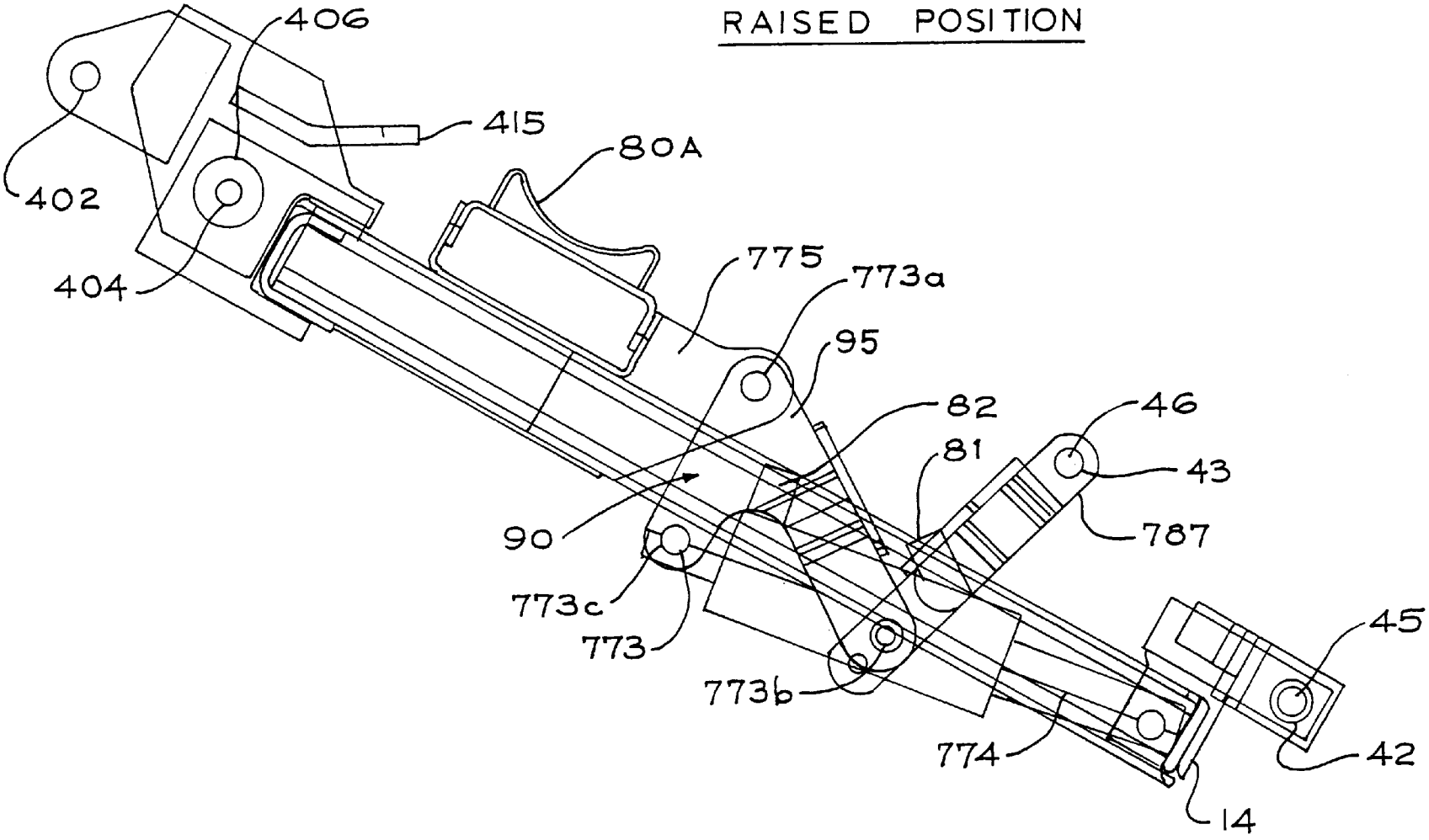
FIG. 18A is a side elevational view of the bell crank lifting system used in combination with the articulated plow system in the raised position.

The hydraulic control/power unit 80 is connected to the reactive controlled pressure mechanism or hydraulic cylinder 91 by hoses 81 and 82. The hydraulic control unit 80 supplies non-compressible fluid, hydraulic oil, to the cylinder 91. Hydraulic cylinder linkage 90, a bell crank, is connected to hydraulic cylinder 91. The hydraulic control/power unit 80 is located in cradle 80*a*, best seen in FIGS. 18 and 18*a*, and is positioned to be forward and of the vehicle to which the present invention is mounted. This removes effective weight from the vehicle and to the wearstrip of the plow as well as aiding in maintaining the vehicle's center of gravity, as designed in the vehicle by the vehicle manufacturer.

The reactive constant pressure system works as follows:

To raise the plow moldboard 100 the operator actuates switch 61 as shown in FIG. 2 to the up position. Now referring to FIG. 11, the four way valve 110 and the two way valve 111 are de-energized. The switch 62 can be in either position when the switch 61 energizes the pump 112, valve 111 blocks the flow to the reservoir 120. This causes the oil to flow into valve 110 from port 3 and out of valve 110 through port 2 into the rod end 92 of the cylinder 91. This lifts the plow moldboard 100. The opposite end of the cylinder 91 is open to the reservoir 120 through ports 4 to 1. When the cylinder 91 is completely extended the pump 112 is turned off by releasing the control switch 61.

Figure 8:
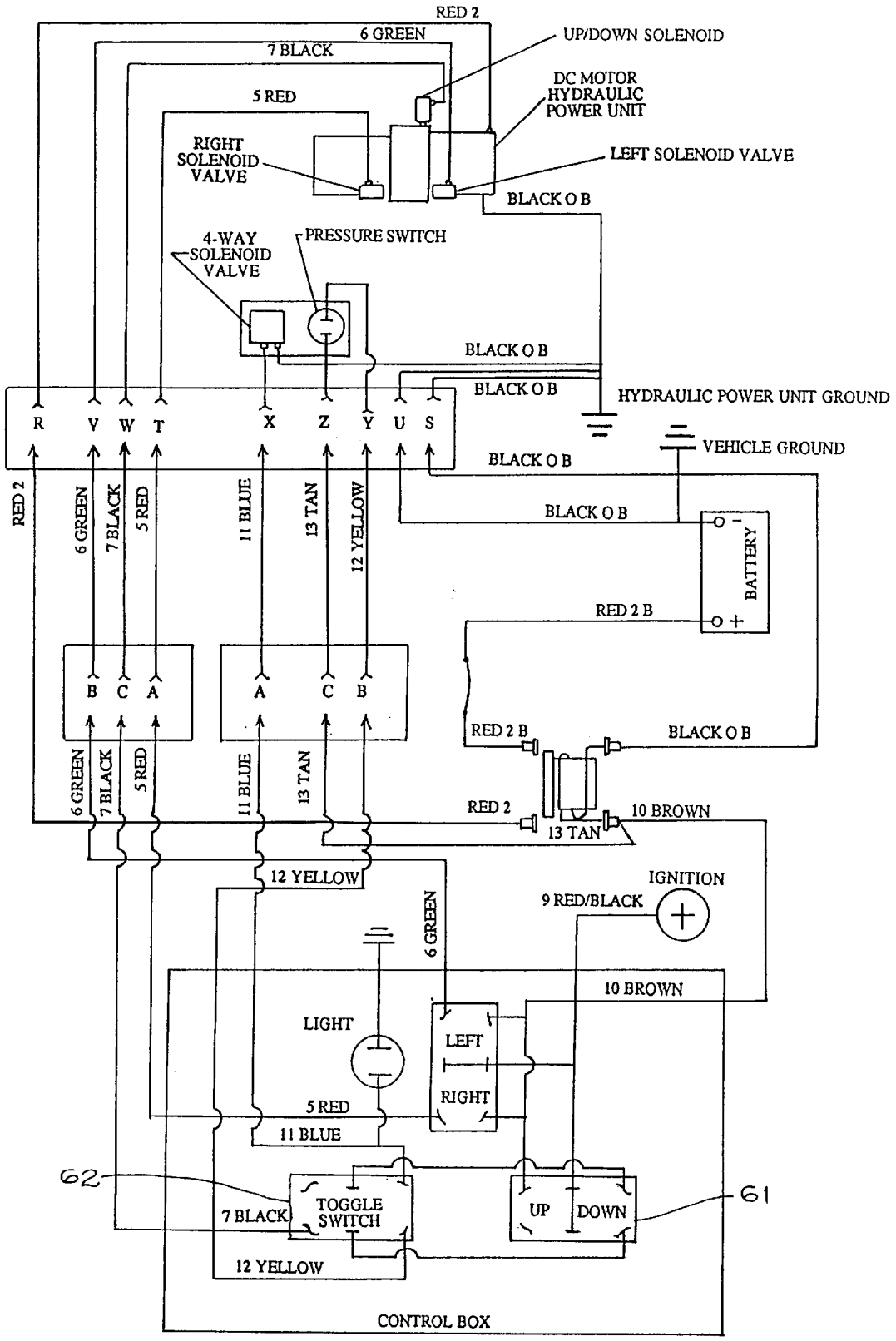

To hold the plow moldboard 100 in a raised position for transport, the switch 61 is held in a neutral position and the switch 62 can be in either position as shown in FIG. 8. This position de-energizes the pump 112 and the valves 110 and 111. Valve 111 blocks oil flow to the reservoir so that the raised position of the plow is maintained. See FIG. 11.

Figure 9:
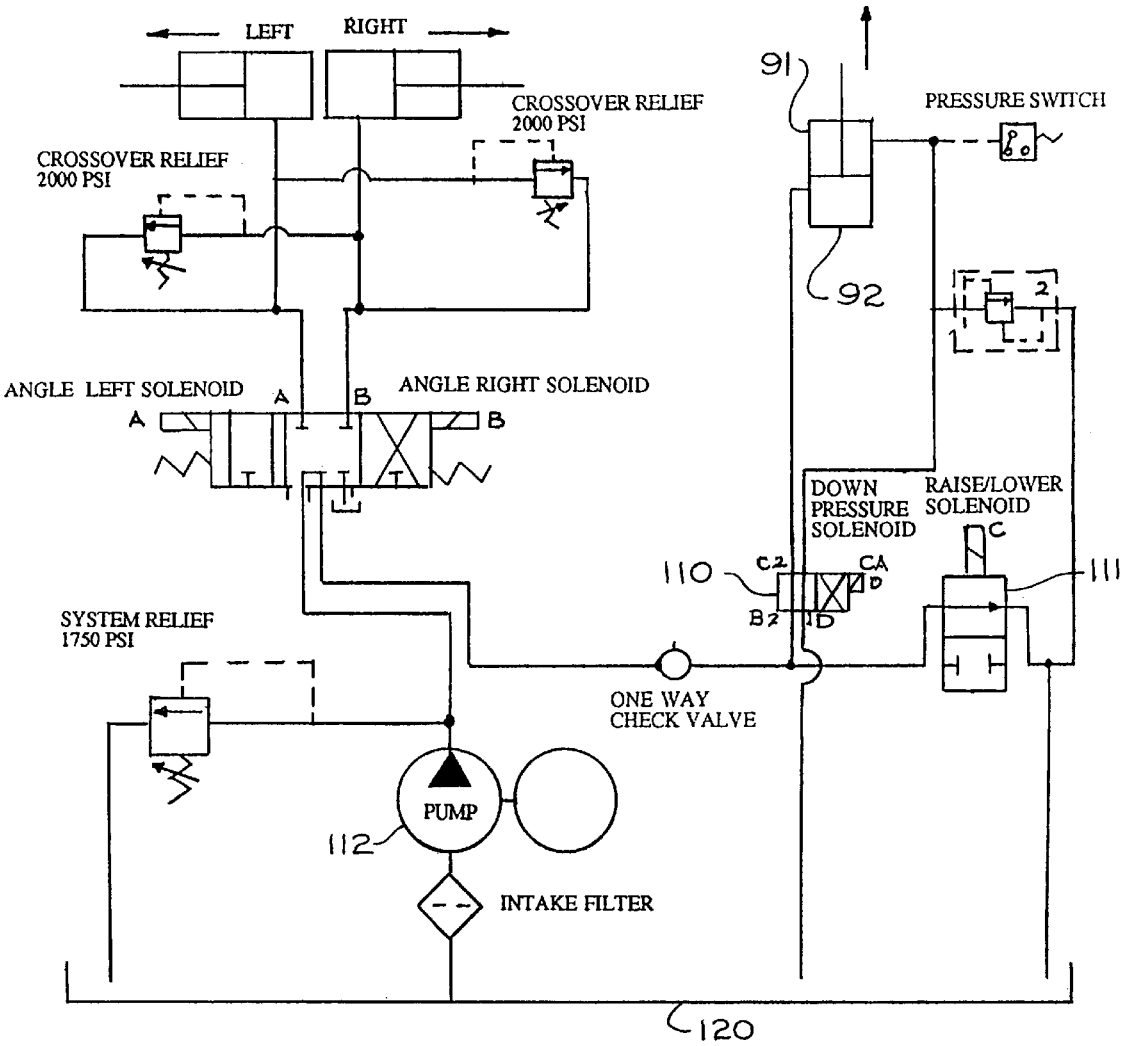

To float the plow moldboard 100 so that it is in the down position but has no down pressure on it, the control switch 61 is depressed to the down position and control switch 62 is depressed to the float position. See FIG. 5. Referring to FIG. 9, this energizes valve 111 and de-energizes valve 110. Energizing valve 111 opens the rod end 92 of the cylinder 91 to the reservoir 120. Thus both ends of the cylinder 91 are connected to the reservoir 120 and the moldboard 100 will float.

Figure 6:
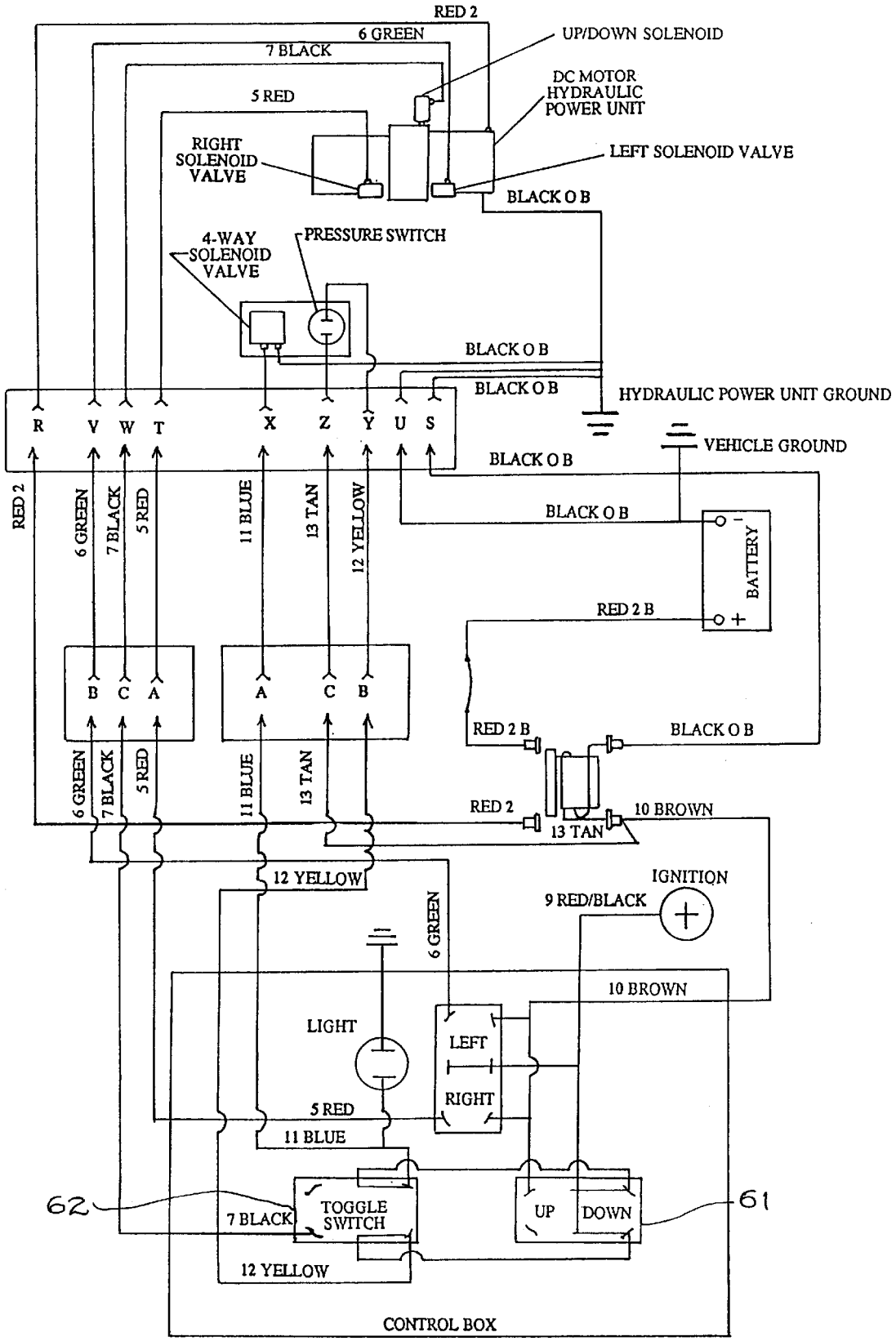
Figure 7:
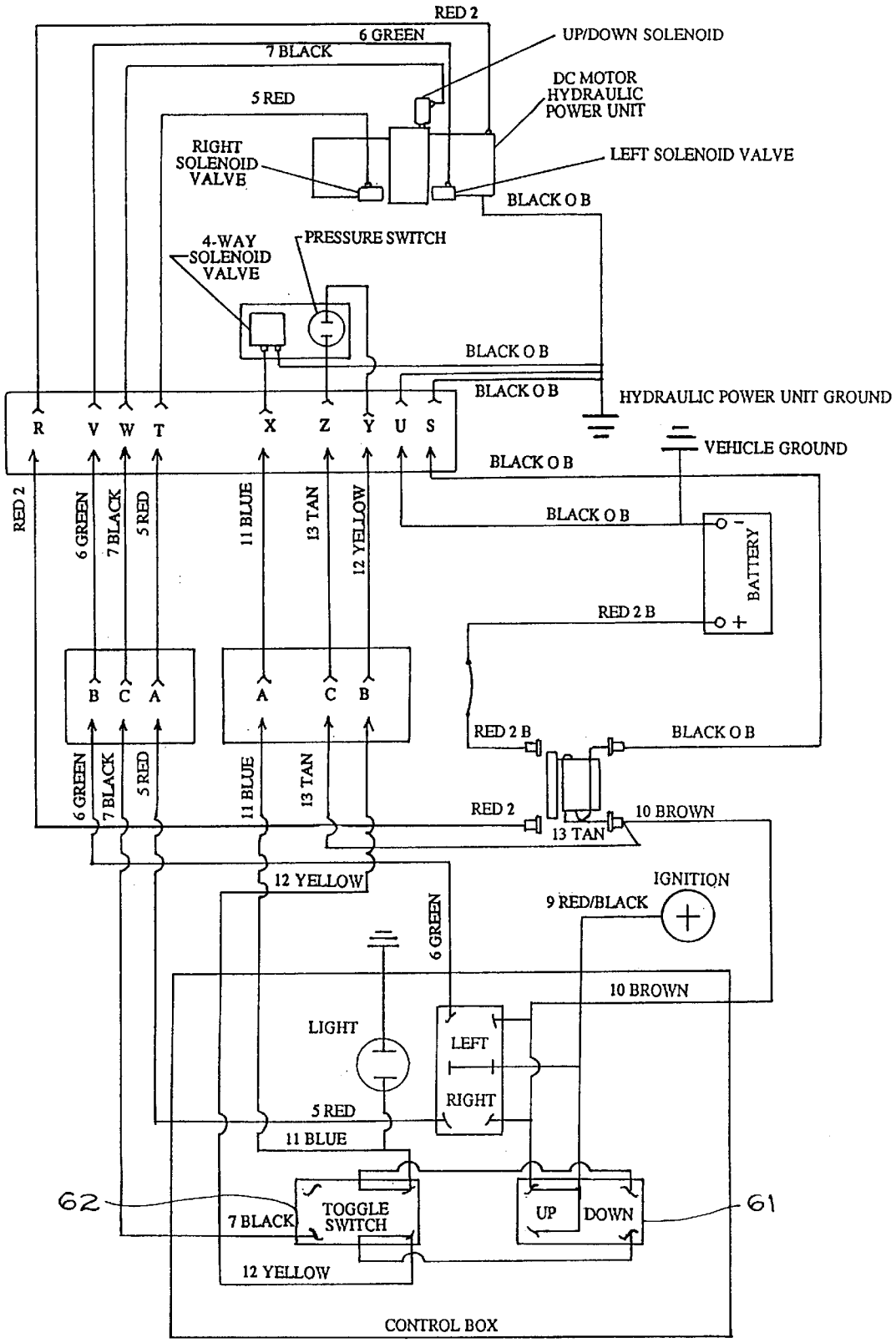
Figure 10:
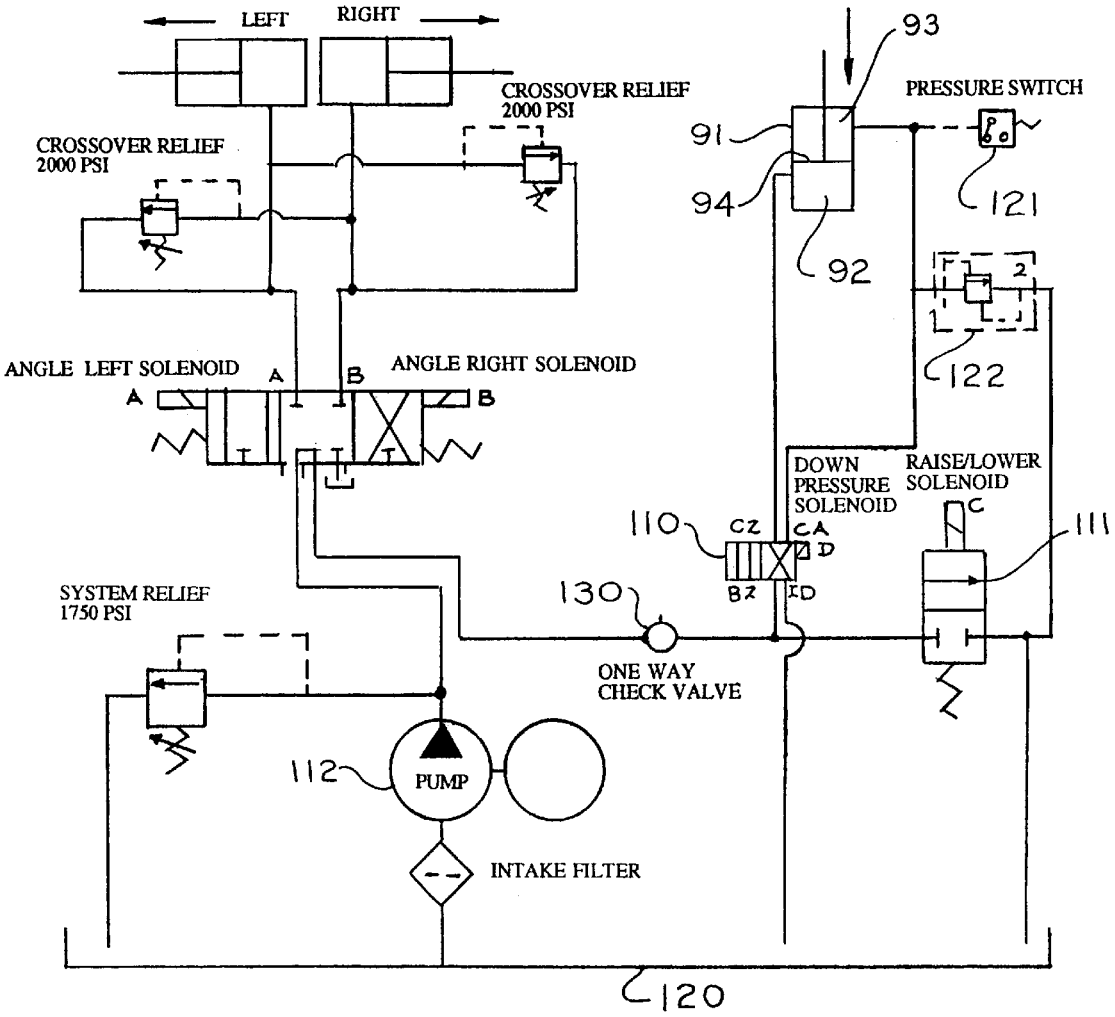

To apply a predetermined down pressure to the plow moldboard 100, the control switch 61 is depressed to the down position and control switch 62 is depressed to the pressure position as shown in FIG. 6. This energizes the four way valve 110 and connects a pressure switch 121 to the pump activating circuit as shown in FIG. 10. Energizing valve 110 reverses the flow of oil from the pump 112 to the opposite end 93 of the cylinder 91 putting a predetermined amount of pressure upon the bottom edge 101 of the plow moldboard 100.

When the pressure on the piston 94 of the hydraulic cylinder 91 reaches the predetermined pressure that has been set, the pressure switch 121 activates and opens the circuit stopping the pump 112. The check valve 130 in the line prior to valve 110 retains the oil in the piston 94 so that the there is a controlled predetermined pressure maintained on the bottom edge 101 of the moldboard 100.

If the bottom edge 101 of the moldboard 100 rises, e.g. due to a change in road surface, sufficient to increase the pressure within the cylinder 91 beyond a predetermined high pressure setting, then the relief valve 122 opens and oil is allowed to flow back into the reservoir 120 until the pressure in the cylinder 91 drops down to below the predetermined high pressure setting.

Once the situation causing the high pressure abates, the pressure can drop down to a predetermined low pressure setting when the bottom edge 101 of the moldboard returns to a normal plowing position. At this predetermined low pressure the pressure switch 121 again activates the pump 112 and oil is pumped from the reservoir 120 into the cylinder 91 until the predetermined nominal pressure is again reached.

It should be noted that it is not necessary for there to be a pressure increase before there is a pressure drop. If the plow moldboard 100 drops into a depression on the surface being plowed, the oil pressure in the cylinder 91 could drop below the predetermined minimum setting. This drop would also be sensed by the pressure switch 121 and cause activation of the pump 112 to increase the pressure in the cylinder 91 back up the predetermined nominal pressure setting.

Furthermore, it should be noted that the plow moldboard 100 can be raised without releasing control switch 62 from the pressure position. By merely depressing control switch 61 to the up position, the plow moldboard 100 is lifted without disengaging the down pressure system. When the moldboard 100 is subsequently lowered, the predetermined downward pressure is again applied to the bottom edge 101 of the plow moldboard 100.

In its specific embodiment the pressure differential is set so that the difference between the highest internal pressure in the cylinder 91 and the lowest internal pressure will allow the plow moldboard 100 to follow the surface contour of the road over small variations without activating the pump 112 or relief valve 122 and yet react to maintain a nearly constantly controlled pressure upon the bottom edge 101 of the plow moldboard 100.

In the preferred embodiment, the nominal pressure setting is 500 psi, the low pressure setting is 450 psi, and the high pressure setting is 600 psi. It is to be understood, however, that different pressure settings can be used to obtain the optimum weight transfer if this system is used with heavier or lighter weight snow plows or if the geometry of the lift mechanism is changed.

Referring now to FIGS. 13–26, it may be seen how the above noted innovations, as well as other novel concepts, may be combined with an articulated plow system 500.

Figure 11:
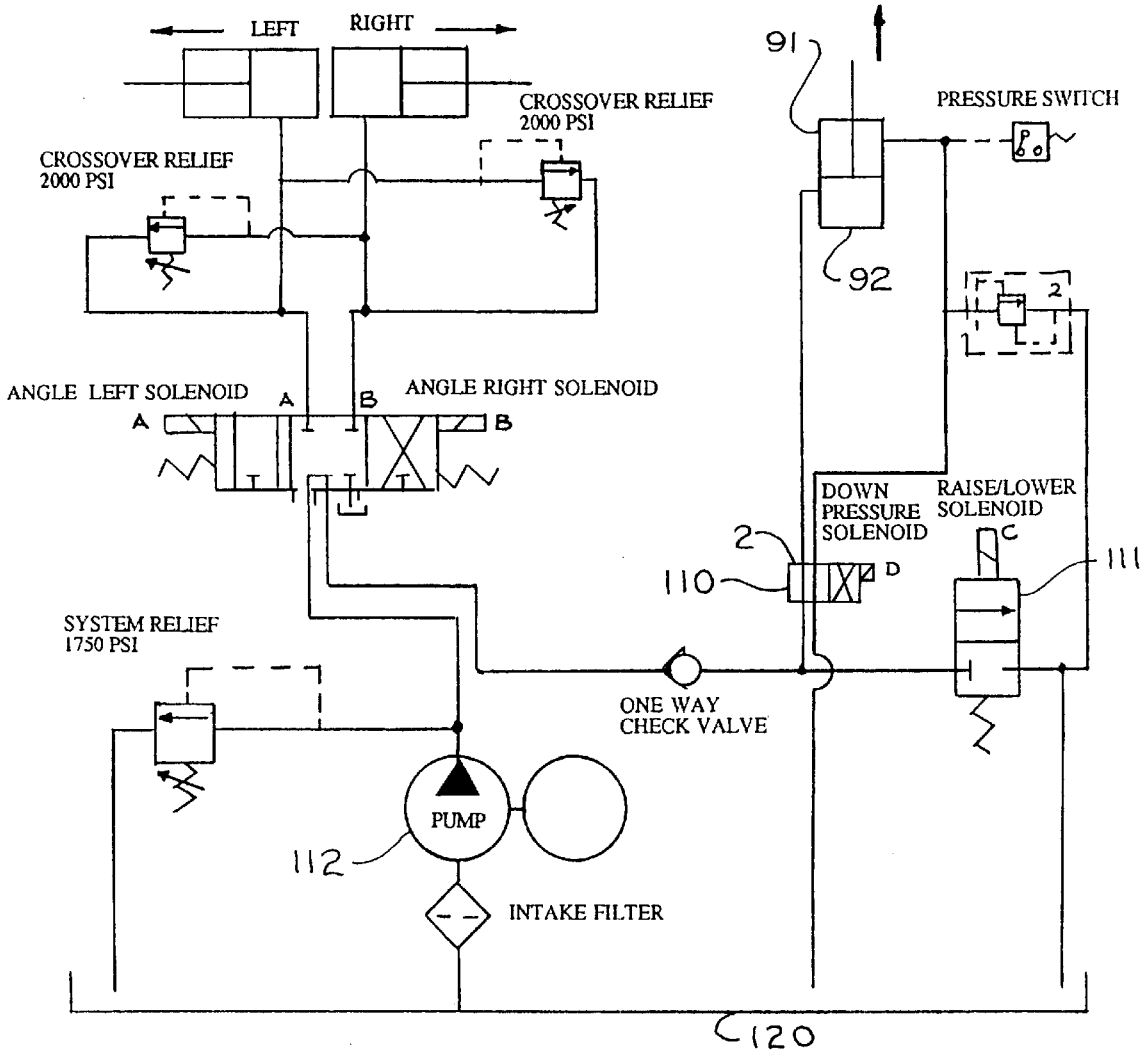
FIG. 11 is a schematic view showing the hydraulic control system in the raise and hold position.
Figure 13:
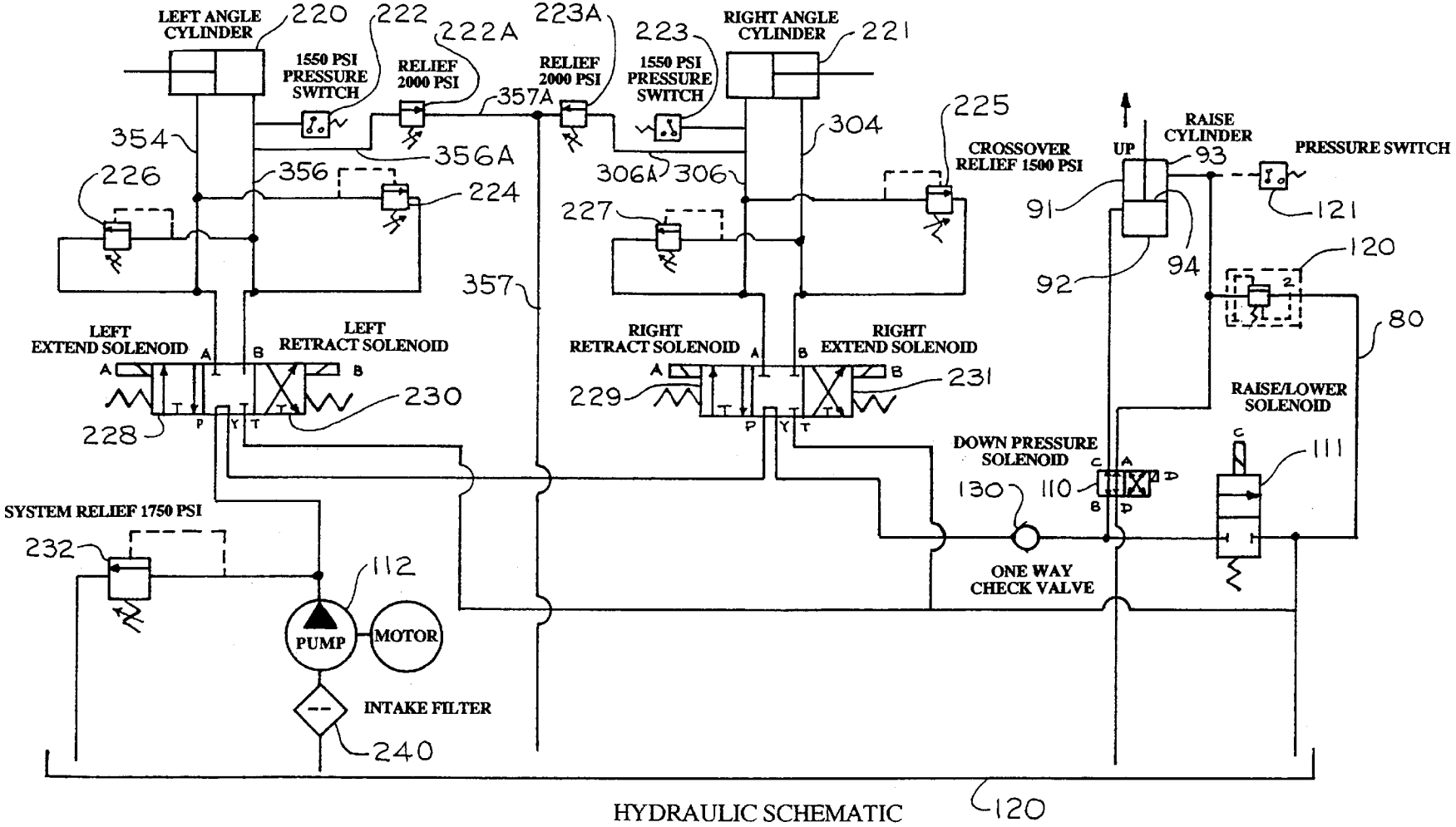
FIG. 13 is a schematic view of the hydraulic system of the articulated plow system.

Referring to FIG. 13, the hydraulic control unit or system 80 may be seen to be modified from the hydraulic control system 80 previously discussed in FIGS. 9–11. As may be seen FIG. 13, the hydraulic control unit 80 for the articulated plow system 500 now further includes, in addition to the structures disclosed in FIGS. 9–11, a left angle cylinder 220, a right angle cylinder 221, 1600 psi pressure switches 222 and 223, four 1500 pound per square inch (psi) crossover relief solenoid valves 224–227, two 2000 psi reservoir dump valves 222*a* and 223*a,* a left angle cylinder extension solenoid 228, a left angle cylinder retract solenoid 230, a right angle cylinder extension solenoid 229, a right angle cylinder retract solenoid 231, a 1750 psi system relief solenoid valve 232 (previously disclosed in FIGS. 9–11), and an intake filter 240 (previously disclosed in FIGS. 8–10).

Figure 14:
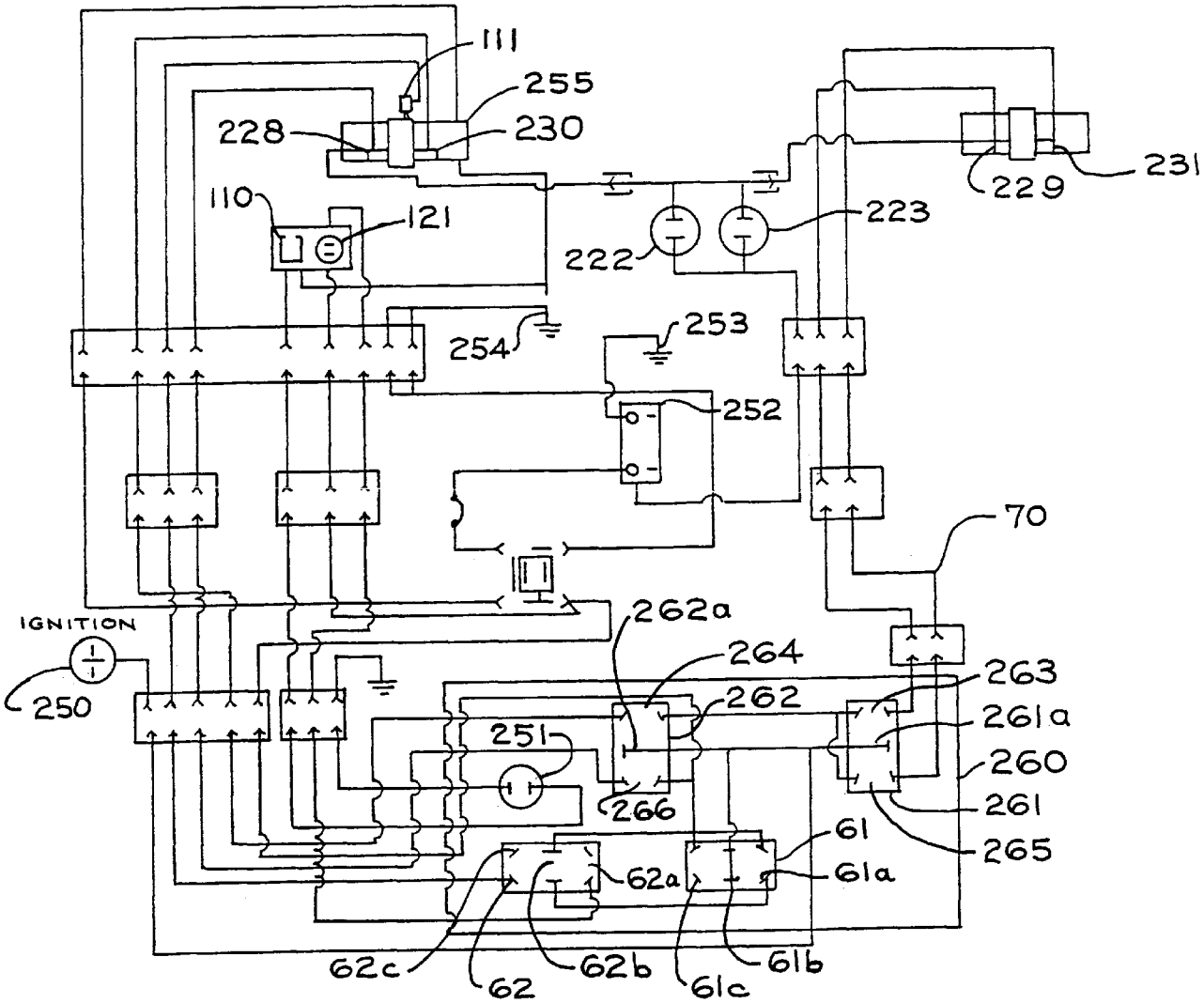
FIG. 14 is a schematic view of the electrical system of the articulated plow system.

Referring now to FIG. 14, a wiring schematic for the articulated plow system 500 may be seen. As may be understood by reference to FIGS. 5–8 the wiring schematic for the electrical control unit 70 has been modified to provide for the desired unique functions of the articulated plow system 500.

The electrical control unit 70 for the articulated plow system 500 includes an ignition 250, a control box 260, a right cylinder extend and retract switch 261 having. a toggle 261*a* and a retract contact 263 and an extend contact 265, a left cylinder extend and retract switch 262 having a toggle 262*a* and a retract contact 264 and an extend contact 266, a left cylinder pressure switch 222, a right cylinder pressure switch 223, a system indicator light 251, the vehicle battery 252, the vehicle ground 253, a hydraulic power unit ground 254, and a hydraulic power unit 255. Further, it should be noted that switch 61 has a plow down position contact 61*a*, a toggle 61*b*, and a plow up contact 61*c*. Switch 62 has a down pressure engagement contact 62*a*, a toggle 62*b*, and plow down and float contact 62*c*.

Figure 15:
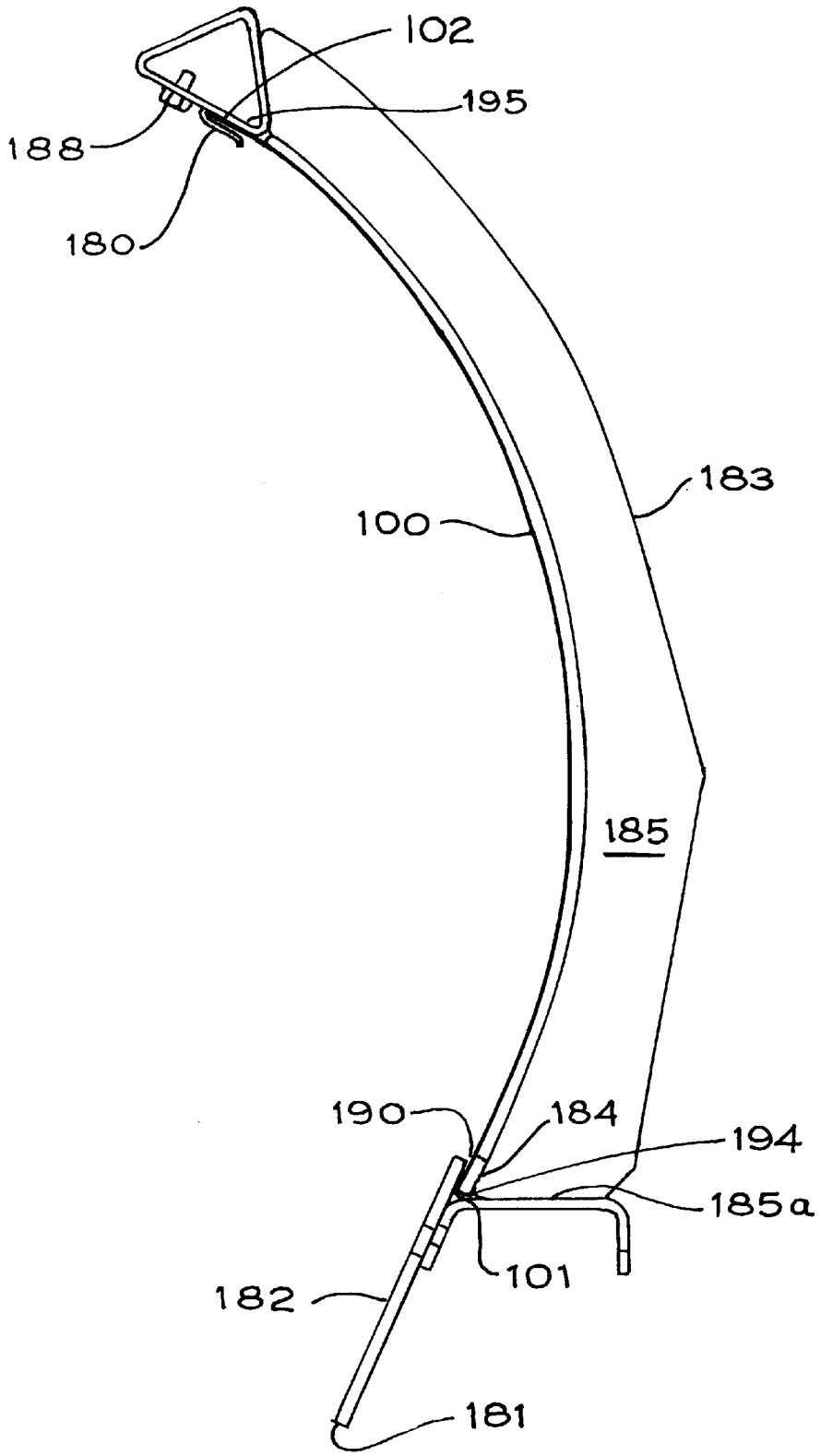
FIG. 15 is a side elevational view showing a retaining structure for retaining the moldboard on the articulated plow system.
Figure 16:
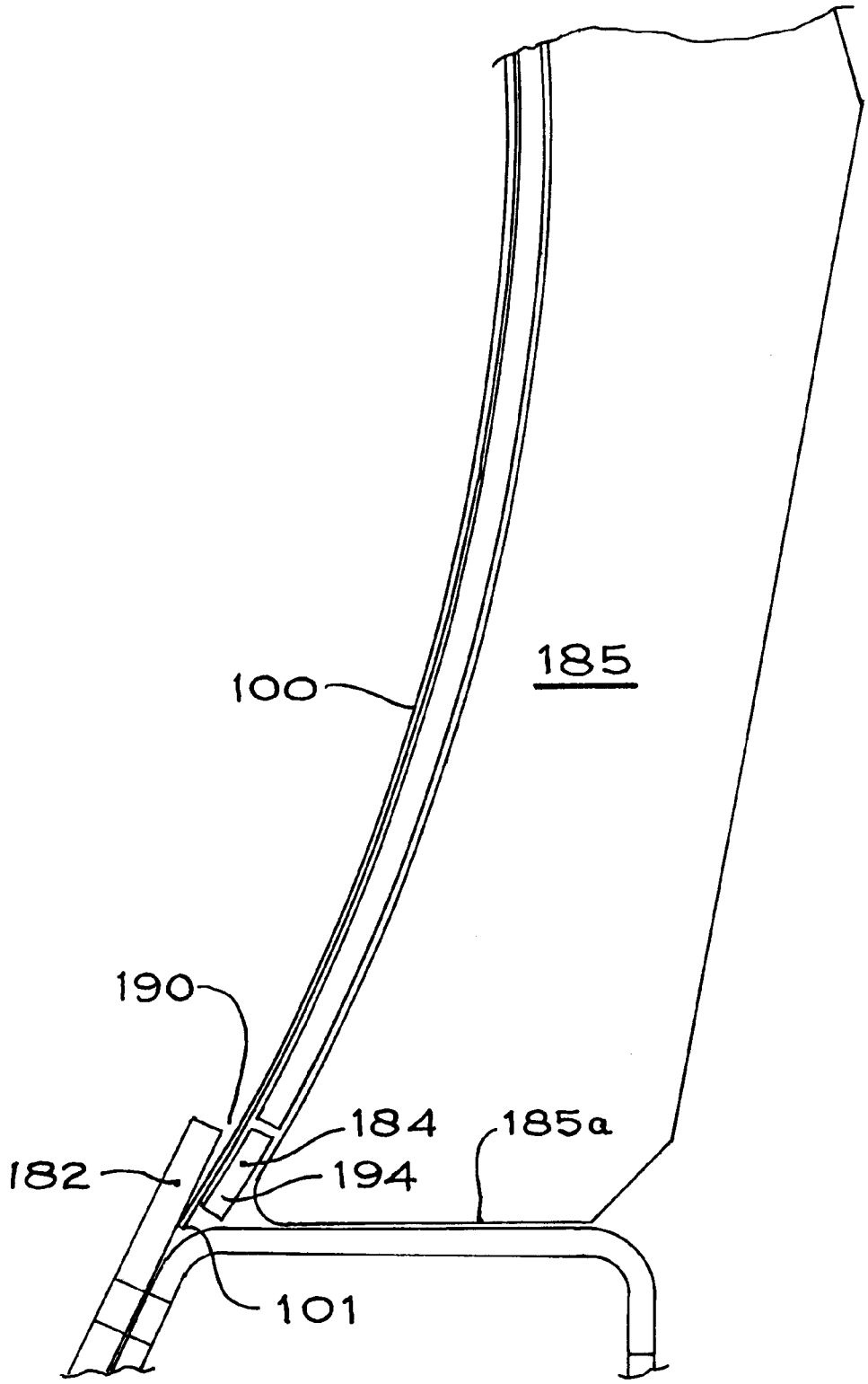
FIG. 16 is a side elevational view showing the bottom portion of the retaining structure for retaining the moldboard on the articulated plow system.
Figure 17:
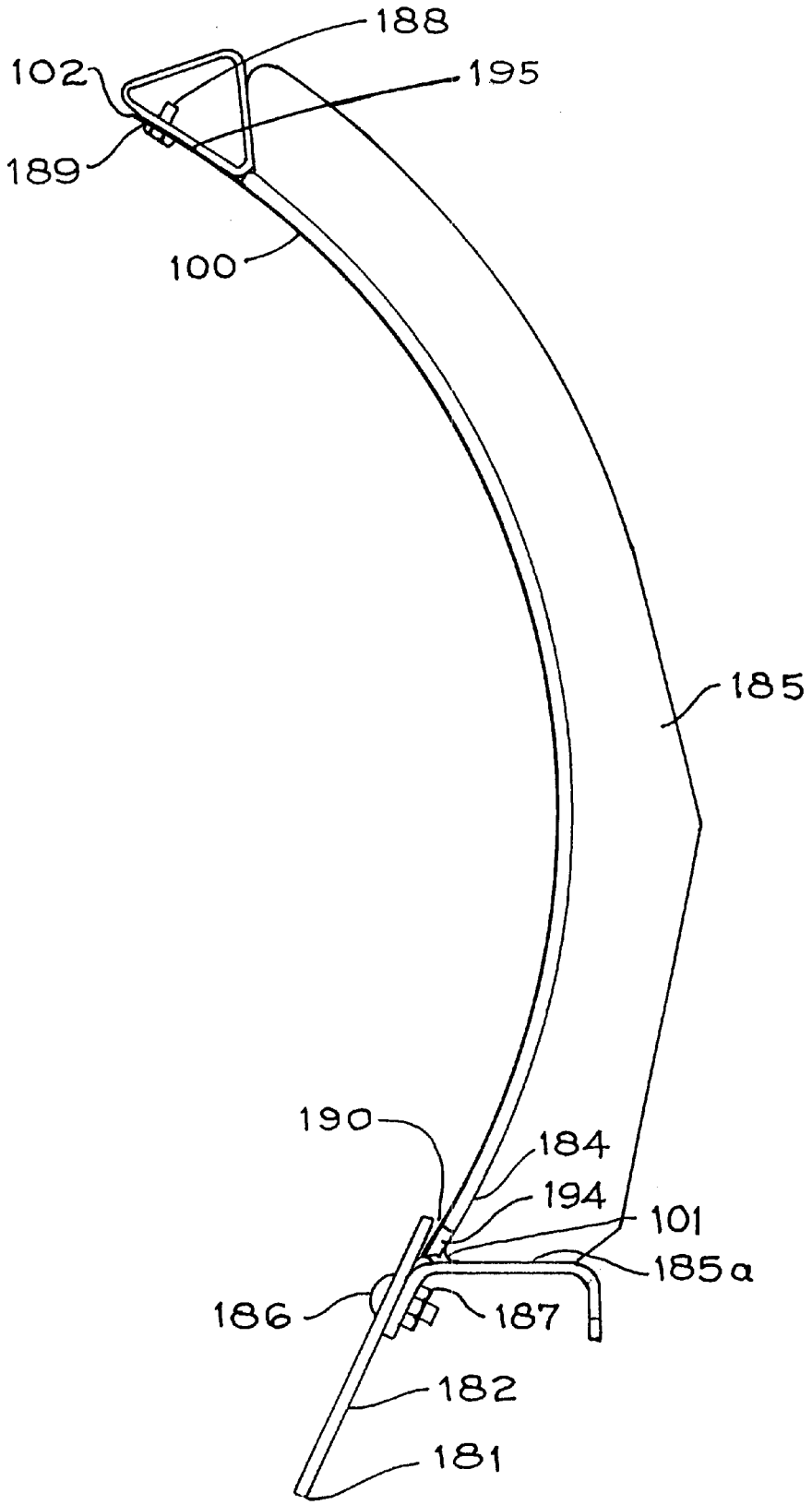
FIG. 17 is a side elevational view showing an alternative retaining structure for retaining the moldboard on the articulated plow system.

Referring now to FIGS. 15–17, a unique combination of the articulated plow system 500 with a mounting system for mounting the moldboard 100 may be seen. The combination may be seen to be comprised of the moldboard 100 having a top a edge 102 and a bottom edge 101, a retainer strip 180, a wearstrip 182 having a bottom edge 181, a channel 190, a blade frame 184 having an upper edge 195 and a lower edge 194, bolts 186 and 188, nut 187, slot 189, and ribs 183. Each section 300, 350, and 400 of the articulated plow system 500 is collectively identified in FIGS. 15-17 by blade section 185 since this mounting system may be used individually on each respective section 300,350, or 400 of the articulated plow system 500. Reference number 185*a* indicates the lower edge of each plow blade section 185. However, it should be noted that in the presently proposed commercial embodiment of the present invention 10 only sections 300 and 400 are envisioned to use the above noted mounting system.

Referring specifically to FIG. 15, the retaining system works by sliding the moldboard 100 into the channel 190 and then placing retainer strip 180 over the top edge 102 of the moldboard 100 by mounting it to the upper edge 195 of the blade frame 184 with the bolt 188. Alternatively, the moldboard 100 may be retained by sliding the moldboard 100 into the channel 190, as noted above, but providing slots or openings 189 along the top edge 102 of the moldboard 100 through which the retaining bolt 188 may pass directly into the upper edge 195 of the blade frame 184.

Referring to FIG. 16, the channel or gap 190 presented between the lower edge 194 of the blade frame 184 and the wearstrip 182 may be seen. This mounting system presents a unique mounting structure for mounting a moldboard 100 to an articulated plow system 500. It allows a person using the plow system 500 to easily replace a moldboard 100 on any section 185 of the plow system 500 or to even stack moldboards 100, if desired, on the plow system 500.

Referring now FIGS. 1,2, 18, 18A, and 21 the bell crank lift system used in combination with the present invention may be seen. The bell crank lift system is specifically disclosed in FIGS. 18 and 18A but reference should also be made to FIGS. 1,2, and 21 to understand the relationship of the various parts of the bell crank lift system as disclosed herein.

The bell crank lift system of the articulated snow plow system 500 is coupled between the front of the vehicle (not shown), at the subframe 12, and a forward portion of the A-frame 14 to permit vertical adjustment of the mounting plowblade section 400 and the extending plowblade sections 300 and 350. A cylinder 91 has a piston rod 774 The cylinder 91 is coupled at an end 773 to end 773*c* of bell crank 95 and at end 775 to the A-frame 14 for moving the bell crank 95 to cause vertical adjustment of the articulated plow system 500 of the present invention. Hydraulic fluid for extending and retracting the piston rod 774 is supplied to the cylinder 91 through hoses 81 and 82, shown best in FIG. 2. The bell crank lift system of the present invention further includes a first link 787 which is coupled, at point 43, to the vehicle subframe 12. First link 787 is also coupled to a second generally L-shaped link member 95, having end 773*b*, end 773*c*, and corner structure 773*a*, at end 773*b*. First link 787 being pivotally coupled to L-shaped link member 95 at end 773*b*. End 773*c*, as noted above, is pivotally coupled to the cylinder 91 at end 773. The angular corner 773*a* of the L-shaped linkage 95 is pivotally coupled to a bell crank coupling bracket structure 775 at corner 773*a*. Accordingly, hydraulic fluid may be added to or removed from the cylinder 91 through hoses .81 and 82 in order to raise or lower the A-frame 14 and the plow system 500 is response to the conditions presented.

Figure 19:
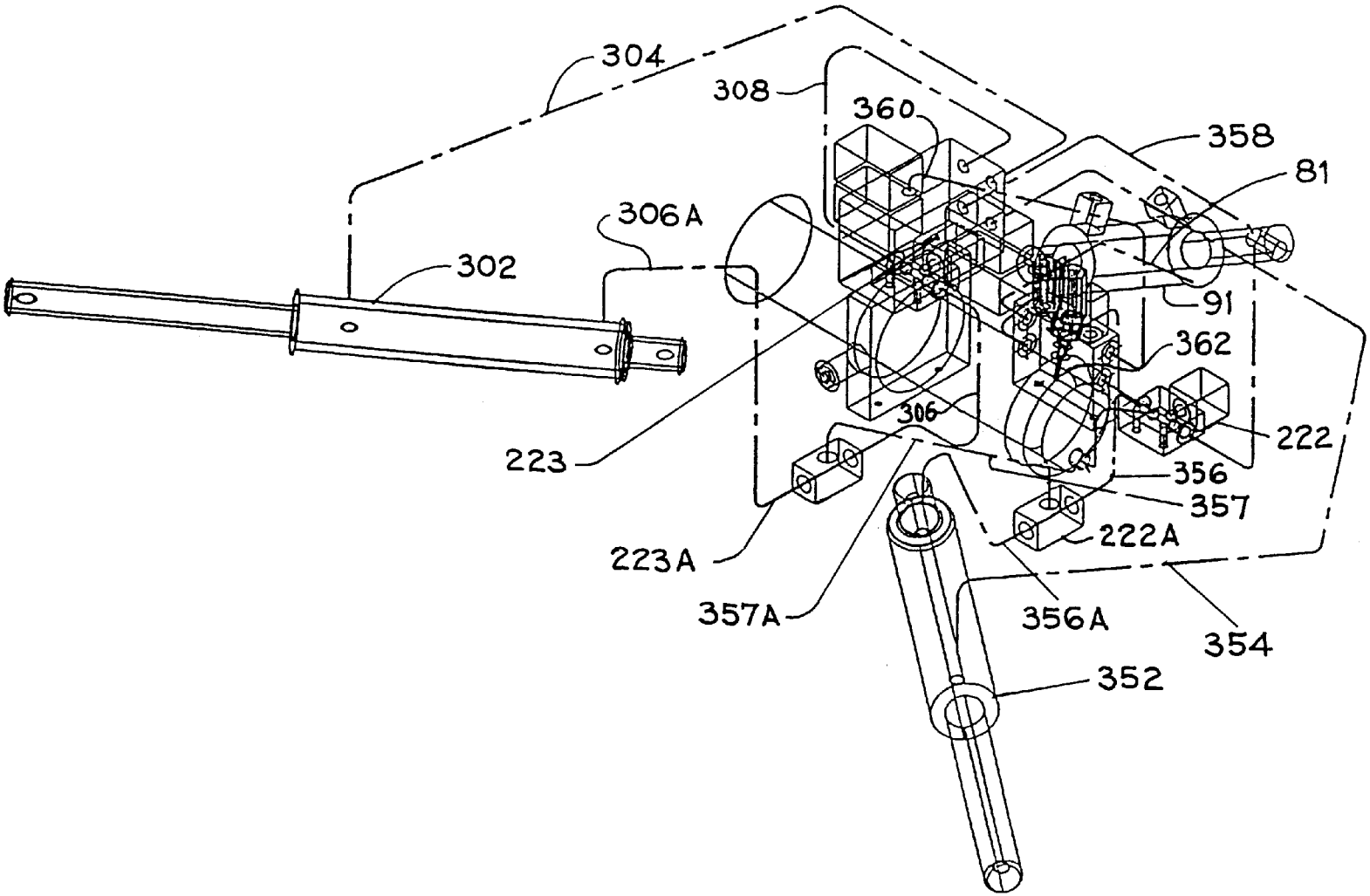
FIG. 19 is a schematic view showing the relationship of the hydraulic lines of the dual acting cylinders, which extend from the mounting plowblade section to the extending plowblade sections, and the valve block.

Referring now to FIG. 19 an exploded schematic view of the hydraulic system of the articulated snow plow system 500 may be seen. FIG. 19 shows that the hydraulic system includes right cylinder retraction line 304, left cylinder retraction line 354, right cylinder extension line 306A and 306, left cylinder extension line 356A and 356, pump line 308 to pressure switch 223, pump line 358 to pressure switch 222, right wing cylinder 302, left wing cylinder 352, pump line 360 to the down pressure valve block 362, drain line 364 to reservoir 120, hydraulic line 81 to cylinder 91 for providing hydraulic fluid to extend cylinder 91, and hydraulic line 82 to cylinder 91 for providing hydraulic fluid to retract cylinder 91. Further, 2000 psi relief valves 222A and 223A are provided between lines 356A, 356 and 306A, 306, respectively. Lines 356A,356 and 306A,306 each respectively and effectively operate as one contiguous hydraulic line, however, when there is a substantial pressure within the hydraulic system (in the specific embodiment disclosed herein the specific pressure is in excess of 2000 psi) either or both relief valves 222A and 223A will open to line 357A which is connected to hydraulic line 357. This will dump excess hydraulic fluid into the system reservoir 120 and relieve the excess pressure within the system.

Figure 20:
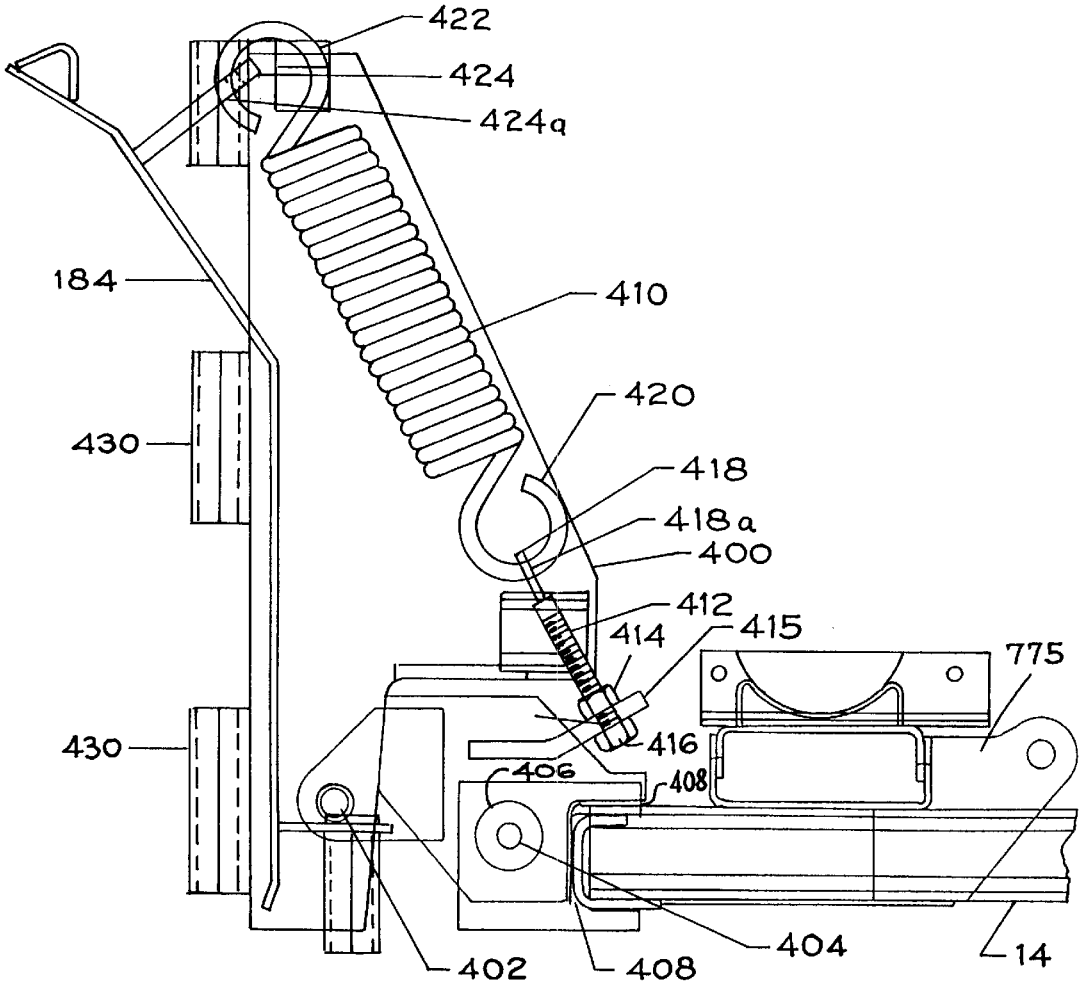
FIG. 20 is a side elevational view showing the blade center section (the mounting plowblade section), the pivot between the center blade section and the carrier, and the pivot and rubber torsion bushing carrier structure.
Figure 20A:
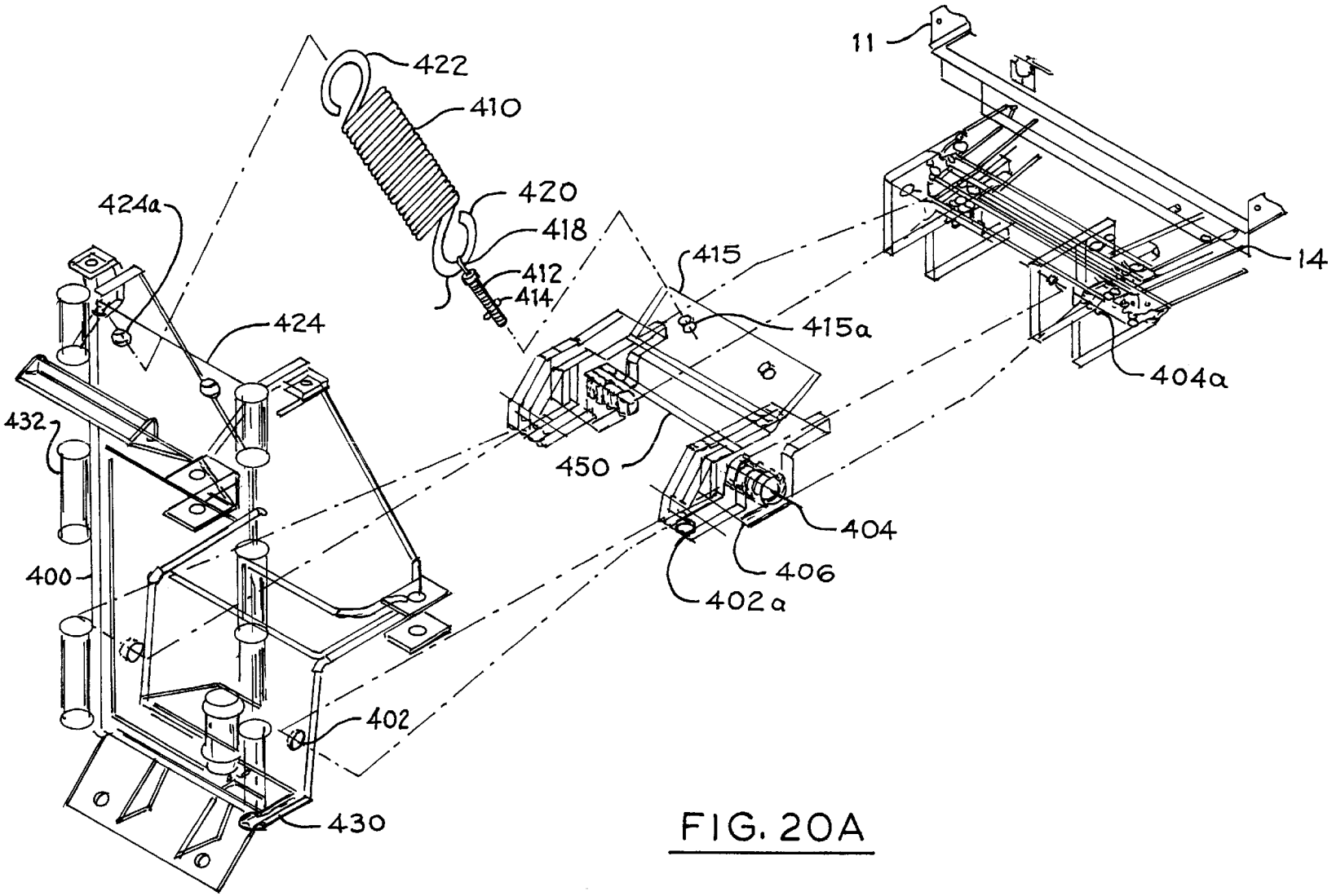
FIG. 20A is an exploded view showing the blade center section (the mounting plowblade section), the pivot between the center blade section and the carrier, and the pivot and rubber torsion bushing carrier structure.
Figure 21:
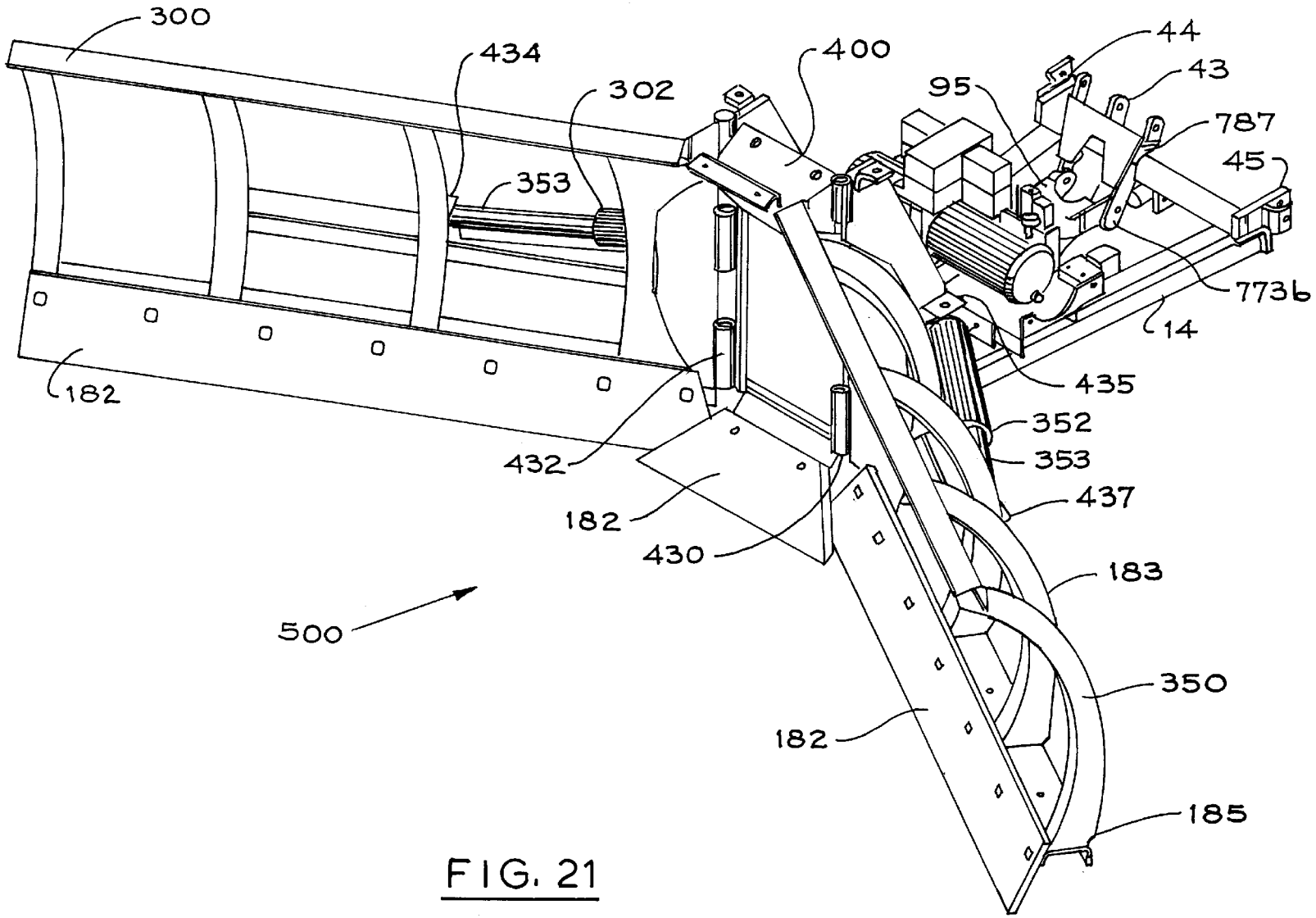
FIG. 21 is a perspective view of the articulated plow system in the swept forward position.
Figure 22:
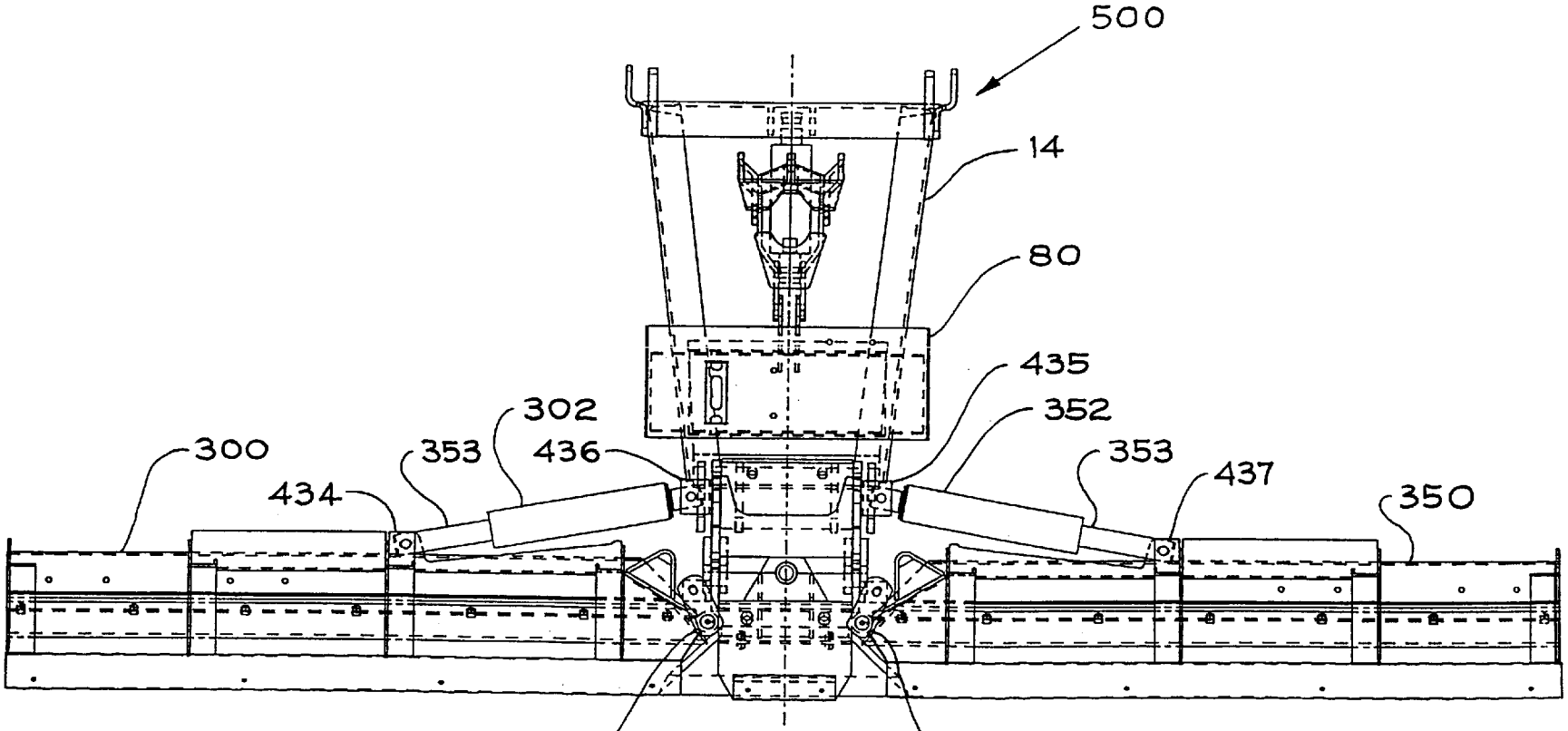
FIG. 22 is a top plan view of the articulated plow system in straight plowing position.

Referring now to FIGS. 20, 20A, and 21, blade center section 400 may be seen to include pivot 402, spring mounting plate 424 having opening 424*a*, left hinge set 430, right hinge set 432, right cylinder coupling 436, and left cylinder coupling 435. Intermediate pivot assembly 450 may be seen to comprise pivot 402*a*, pivot 404, rubber torsion bushing 406, mounting plate 415 having openings 415*a*. Also springs 410 with hooks 420 and 422, adjustment bolts 412, adjusting nuts 414 and 416, mounting plate 418 (integral to bolt 412) having opening 418*a* may also be seen as well as the front portion of A-frame 14 with pivots 404*a* and the noted gaps 408 between A-frame 14 and intermediate pivot assembly 450.

Springs 410 are mounted on hooks 420 and 422 and extend from mounting plate 424 to mounting plate 418. Mount plate 418 is integral to bolt 412. Tension on springs 410 can be adjusted by use of adjusting nuts 414 and 416 which secure bolt 412 in opening 415*a* of mounting plate 415. Accordingly, pivot 402 allows the center section 400 to pivot when the articulated plow 500 trips and spring 410 and its mounts will bias the center section 400 back to operating position.

Additionally, pivot 404 of intermediate pivot assembly 450 acts as an intermediate pivot between the center section 400 and the A-frame 14 which allows a few degrees of motion about a horizontal axis defined by the pivot 404 and 404*a* to permit, in combination with gap 408, a limited amount of float, roughly 5–6 degrees, which allows the articulated plowblade sections 300 and 350 and the blade center section 400 to follow the contour of the ground and also allows for some variation in the mounting height of the vehicle mounting points, rubber torsion bushings 406 provide some resistance to float and reduce the probability of unnecessary motion of the plowblade sections 300, 350, and 400.

Referring now to FIGS. 21–26, the articulated snow plow system 500 may be seen to generally comprise a center section 400 hingedly mounted to a right wing plowblade section 300 and a left wing plow blade 350 by hinges 432 and 430, respectively. As these drawings clearly show the center section of the system 500 has two pivots at hinges 432 and 430 instead of one pivot as shown in the prior art.

Figure 23:
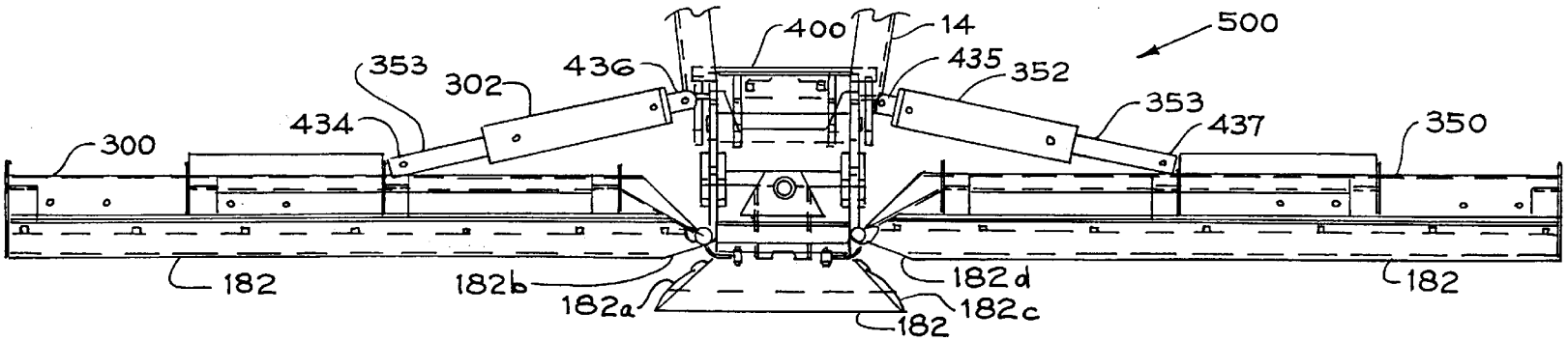
FIG. 23 is a top plan view of the articulated plow system exaggerating the space between the wearstrip of the mounting plowblade section and the wear strips of the plurality of extending plowblade sections to illustrate that the wear strip of the mounting plowblade section overlaps the wearstrips of the extending plow blade sections.

The center section 400, right wing section 300, and left wing section 350 each include a wearstrip 182. Referring to FIG. 23, it may be seen that the wear strip 182 of the center section 400 has side portions 182*a* and 182*c* which respectively overlap end portions 182*b* and 182*d* of the wearstrip 182 of the right wing 300 and the left wing 350. Accordingly, the overlapping wearstrips 182 give complete coverage of the ground surface in front of the plow system 500. No gaps are presented so there is no missed coverage and/or strips of snow remaining on the ground surface.

Figure 24:
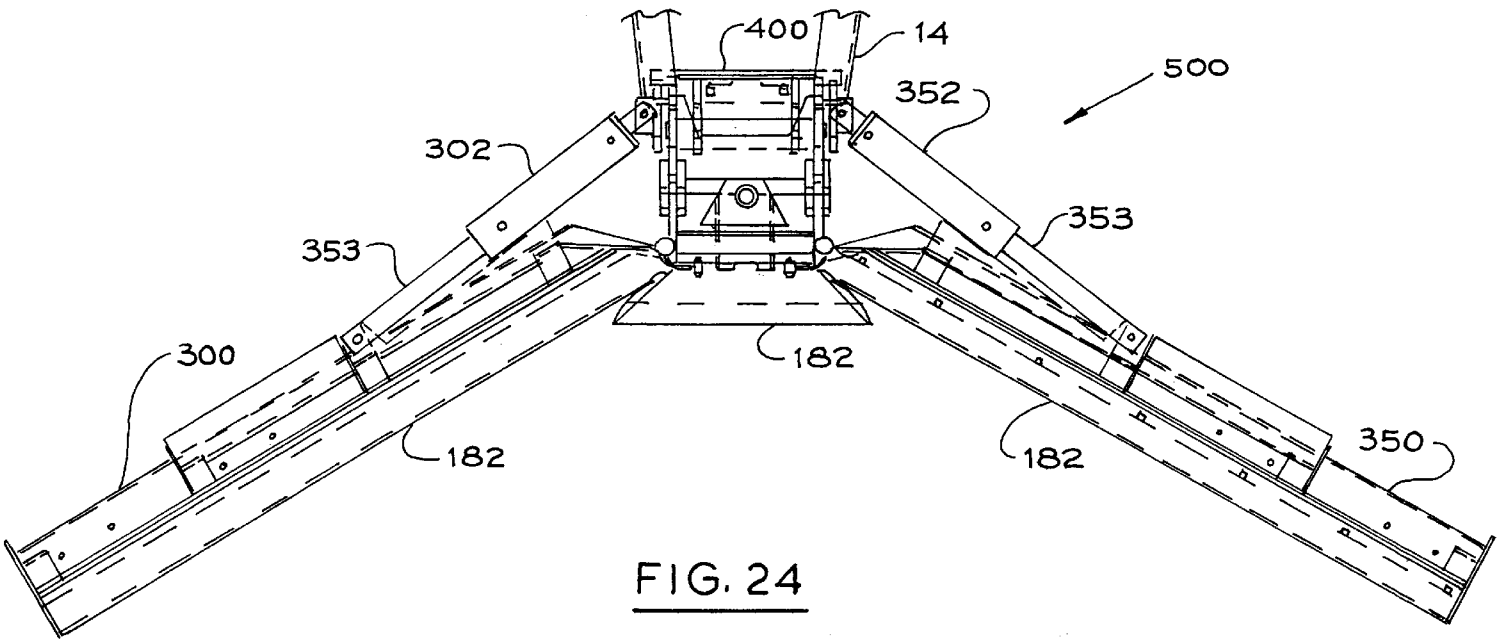
FIG. 24 is a top plan view of the articulated snow plow system showing the extending plow blade sections in the swept forward position.
Figure 25:
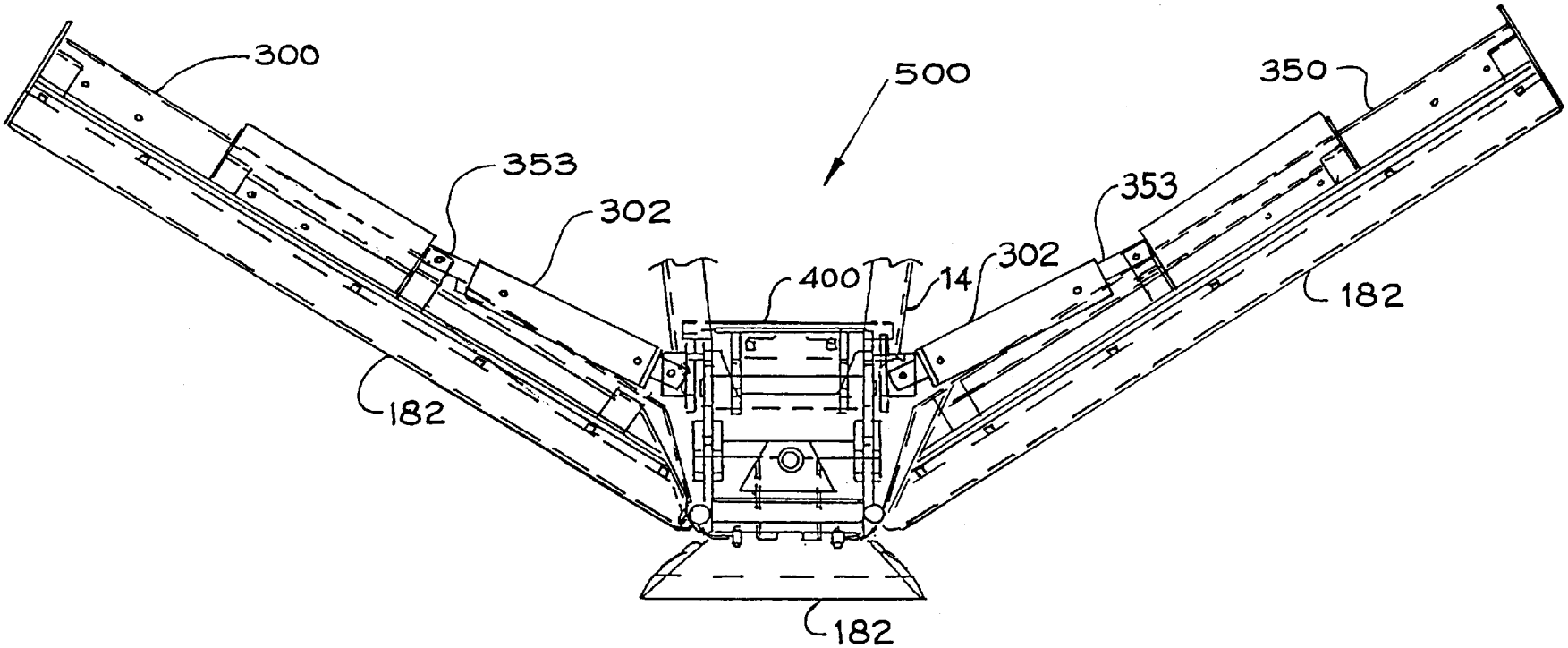
FIG. 25 is a top plan view of the articulated snow plow system showing the extending plow blade sections in the swept back position.

As illustrated in FIGS. 21–26, the wearstrip 182 of the center section 400 is positioned forward of the wearstrips 182 of the left and right plowblade sections 300 and 350. This allows the wearstrips 182 of the plowblade sections 300 and 350 to move without presenting gaps. Also, it is preferred, but not necessary, that the wearstrip 182 of the center section 400 be positioned at a shallower angle, roughly 45 degrees from vertical, than the wearstrips 182 of plowblade sections 300 and 350, which are positioned approximately 25 degrees from vertical, to permit better lifting of hard packed snow at the center section 400. Consequently, in a swept back position, as illustrated in FIG. 25, there would be greater mechanical advantage given to the center section in making the initial contact with the snow or other material to be plowed.

Figure 26:
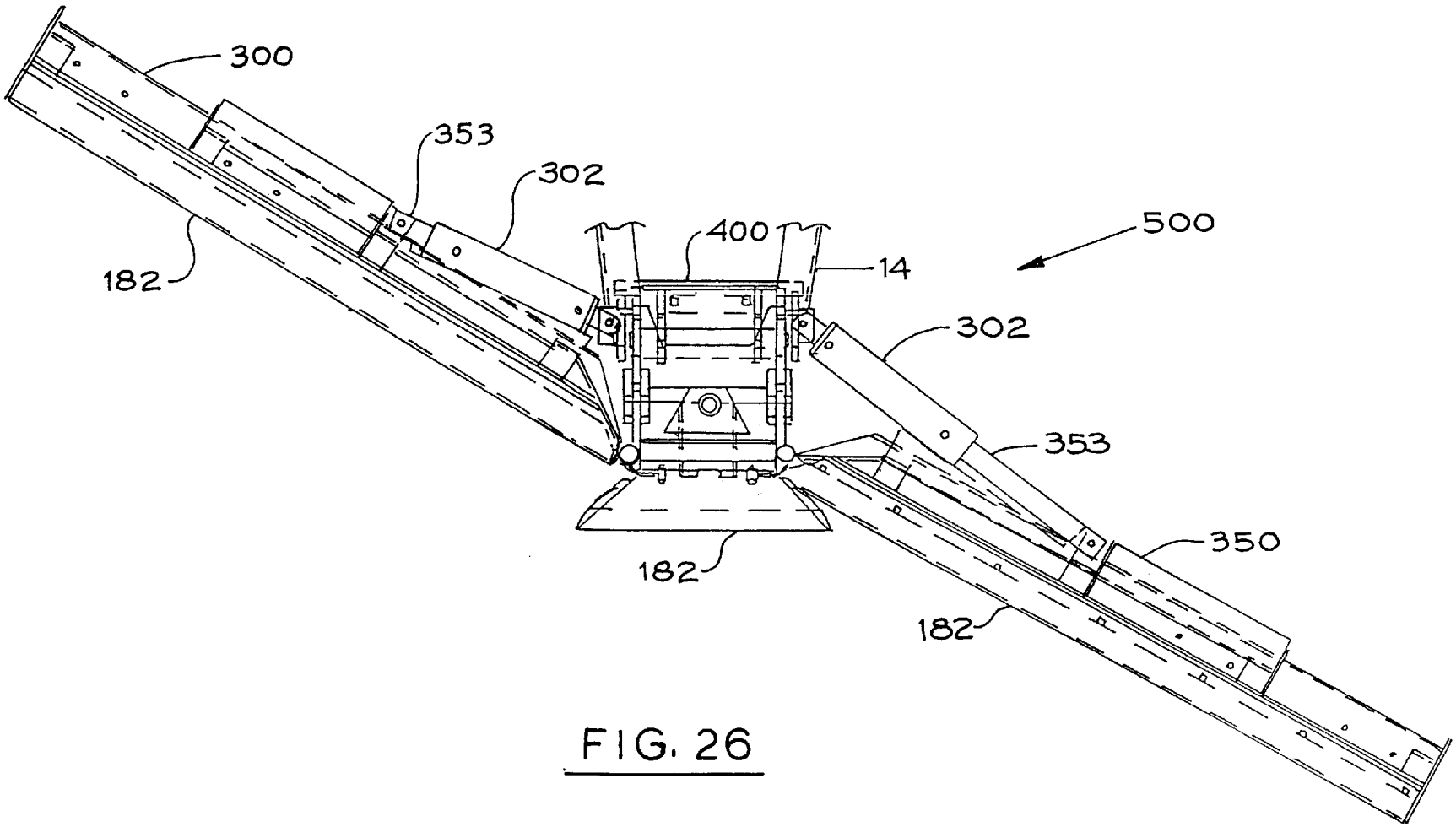
FIG. 26 is a top plan view of the articulated snow plow system showing one extending plow blade section in the swept back position and one extending plow blade section in the swept forward position for pushing snow off to one side of the plow vehicle.

With respect to the actuation of the down pressure system with respect to the articulated plow system 500, the down pressure system is actuated in the same manner as described with respect to FIGS. 1–11 supra. Further, the lifting of the plow system 500 is the same as described with respect to the plow system disclosed in FIGS. 1–11. However, the present plow system 500 also has a pressure sensing ability to permit blade tripping when in the scoop position, as shown in FIG. 24, or when in the system 500 is fully angled in a particular direction as illustrated in FIG. 26.

When one or both wings 300 or 350 are swept forward and in that position strike an object the force from striking the object increases the pressure on the cylinder of the respective wing struck. This results in increased hydraulic pressure in the particular cylinder and hydraulic line on the extend side 228 or 229 (see FIG. 13). When this pressure exceeds 1600 psi (this value may vary depending upon the size and type of system that is used to achieve the desired function) in pressure the contacts of the respective pressure switch, 222 and/or 223 close. This completes the circuit illustrated in FIG. 14 to the two solenoid valves 228 and 229 which allows the hydraulic fluid to be dumped into the reservoir 120. This causes the wings 300 and 350 to be retracted to more straight position like those shown in FIGS. 22 and 23. In this position the normal mechanical tripping action can occur.

Additionally, this allows a wing 300 or 350 to react to the striking of an object by pulling away from that object with a movement that is opposite to the forward motion of the vehicle. This allows some relief from the force of the object struck by the wing. This feature can be used on a plow having a single pivot point as well as the plow system 500 disclosed herein.

The above described embodiments of this invention are merely descriptive of its principles and are not to be limited. The scope of this invention instead shall be determined from the scope of the following claims, including their equivalents.

What is claimed is:

1. A snow plow system for use with a vehicle, said system comprising:

a snow plow including a first plowblade section adapted to be pivoted about a substantially vertical axis between first and second positions;

a second plowblade section adapted to be pivoted about a substantially vertical axis between first and second positions;

first and second fluid pressure devices coupled to the first and second plowblade sections, respectively, the first and second fluid pressure devices each being operatable. between extended and retracted conditions for pivoting the first and second plowblade sections; and first and second pressure switches for sensing pressure within the first and second fluid pressure devices, respectively, the pressure switches each having a trip pressure at and above which the first and second fluid pressure devices are both operated to pivot the first and second plowblade sections to one of said positions.

2. The snow plow system of claim 1, further comprising a further fluid pressure device coupled to the snow plow to permit vertical adjustment of the first and second plowblade sections.

3. The snow plow system of claim 1, wherein the first and second plowblade sections pivot about different axes.

4. The snow plow system of claim 1, wherein the first and second plowblade sections pivot about a common axis.

5. The snow plow system of claim 1, wherein said first and second pressure switches are connected in parallel with one another whereby said first and second fluid pressure device are operated to pivot the first and second plowblade sections to said one position in response to detection of an overpressure condition by either one of the first and second pressure switches.

6. The snow plow system of claim 1 wherein said first and second pressure switches are connected in circuit with at least one valve for operating said at least one valve to allow hydraulic fluid to flow out of the first and second fluid pressure devices in response to detection of an overpressure condition by either one of the first and second pressure switches.

7. A snow plow system for use with a vehicle, said system comprising:

a snow plow including a first plowblade section adapted to be pivoted about a substantially vertical axis between retracted and extended positions;

a second plowblade section adapted to be pivoted about said substantially vertical axis between retracted and extended positions;

first and second fluid pressure devices coupled to the first and second plowblade sections, respectively, the first and second fluid pressure devices each being operatable between extended and retracted conditions for pivoting the first and second plowblade sections to respectively extend and retract the first and second plowblade sections; and first and second pressure switches for sensing pressure within the first and second fluid pressure devices, respectively, the pressure switches each having a trip pressure at and above which the first and second fluid pressure devices are both operated to the retracted condition, thereby pivoting the first and second plowblade sections to the retracted position.

8. A snow plow system for use with a vehicle having a plow support frame, said system comprising:

a snow plow including a first plowblade section adapted to be pivoted about a substantially vertical axis between retracted and extended positions;

a second plowblade sections pivotably pivotable about a substantially vertical axis between retracted and extended positions;

first and second fluid pressure devices coupled to the first and second plowblade sections, respectively, the first and second fluid pressure devices each having an extended position and a retracted position to respectively extend and retract the first and second plowblade sections; and first and second pressure switches for sensing pressure within the first and second fluid pressure devices, respectively, the pressure switches each having a trip pressure at and above which the first and second fluid pressure devices are both operated to their retracted position.

9. The snow plow system of claim 8, wherein the first and second plowblade sections pivot about different axes.

10. the snow plow system of claim 8, wherein the first and second plowblade sections pivot about a common axis.

11. The snow plow system of claim 8, further comprising a mechanism for coupling the snow plow to the support frame of the vehicle floats about a substantially horizontal pivot axis to maintain contact between ground and the first and second plowblade sections.

12. The snow plow system of claim 11, wherein said mechanism defines first and second horizontal pivots between the snow plow and the support frame of the vehicle.

13. The snow plow system of claim 12, further comprising a plow frame structure, and an intermediate pivot assembly coupled to the snow plow at one of the first and second horizontal pivot axes, the intermediate pivot assembly being coupled to the plow frame structure at the other one of the first and second horizontal pivot axes.

14. A method of operating a snow plow system which includes a snow plow having first and second plowblade sections, the first and second plowblade sections being pivotable between first and second positions, said method comprising the steps of:

coupling a first fluid pressure device to the first plowblade section;

coupling a second fluid pressure device to the second plowblade section;

operating the first and second fluid pressure devices to pivot the first and second plowblade sections from the first position to the second position;

monitoring the pressure within the first and second fluid pressure devices; causing the first and second fluid pressure devices to pivot the first and second plowblade sections back to the first position whenever a trip pressure is detected within either one of the fluid pressure devices while the plowblade sections are at a position other than the first position.

15. The method of claim 14, including operating the first and second fluid pressure devices to pivot the first and second plowblade sections to a retracted position whenever the trip pressure is detected within either one of the fluid pressure devices.

16. The method of claim 14, wherein the step of operating the fluid pressure devices includes operating at least one valve to allow hydraulic fluid to flow out of the first and second fluid pressure devices.

* * * * *